US005817452A

United States Patent [19]

Kamosaki

[11] Patent Number: 5,817,452

[45] Date of Patent: Oct. 6, 1998

[54] HEAT DEVELOPABLE COLOR LIGHT-SENSITIVE MATERIAL

[75] Inventor: Tetsu Kamosaki, Kanagawa, Japan

[73] Assignee: Fuji Photo Film Co., Ltd., Kanagawa, Japan

[21] Appl. No.: 934,200

[22] Filed: Sep. 19, 1997

[30] Foreign Application Priority Data

Sep. 19, 1996 [JP] Japan ..... 8-267682

[51] Int. Cl.[6] ..... G03C 8/10; G03C 8/14; G03C 8/20; G03C 8/40

[52] U.S. Cl. ..... 430/562; 430/203; 430/222; 430/223; 430/224; 430/225; 430/402; 430/559; 430/565; 430/505; 430/506

[58] Field of Search ..... 430/203, 223, 430/226, 402, 565, 224, 225, 222, 562, 559, 505, 506

[56] References Cited

U.S. PATENT DOCUMENTS

| | | | |
|---|---|---|---|
| H456 | 4/1988 | Hara et al. | 430/203 |
| 4,483,914 | 11/1984 | Naito et al. | 430/203 |
| 4,500,626 | 2/1985 | Naito et al. | 430/203 |
| 4,503,137 | 3/1985 | Sawada | 430/203 |
| 4,559,290 | 12/1985 | Sawada et al. | 430/203 |
| 5,427,901 | 6/1995 | Arakatsu et al. | 430/203 |

*Primary Examiner*—Richard L. Schilling
*Attorney, Agent, or Firm*—Sughrue, Mion, Zinn, Macpeak & Seas, PLLC

[57] ABSTRACT

A heat developable color light-sensitive material provided on a support, which is for use in an image forming process comprising using a dye fixing element provided on a support separate from the support for the light-sensitive material, superposing one on another, heat developing to form a diffusible dye in the light sensitive material, and transferring the diffusible dye to the dye fixing element to form an image, is disclosed. The light sensitive material comprises at least a light-sensitive silver halide and dye-donating compounds, and forms or releases diffusible yellow, magenta and cyan dyes by the heat development, the diffusible cyan dye comprising at least two kinds of cyan dyes, the yellow dye, the magenta dye and the cyan dye showing the maximum absorption intensity in spectral absorption at a wavelength of from 440 nm to 460 nm, from 525 nm to 545 nm, and from 610 nm to 640 nm, respectively, and the absorption intensity of the cyan dye satisfying the following requirements (1) to (3): (1) the wavelength ($\lambda C(10\%-)$) at which an absorption intensity in the short-wavelength side of the cyan dye reaches 10% of a peak absorption intensity is 525 nm to 545 nm; (2) the wavelength ($\lambda C(10\%+)$) at which an absorption intensity in the long-wavelength side of the cyan dye reaches 10% of a peak absorption intensity is 690 nm or more; and (3) the difference between $\lambda C(10\%+)$ and $\lambda C(10\%-)$ is 155 nm or more.

3 Claims, No Drawings

HEAT DEVELOPABLE COLOR LIGHT-SENSITIVE MATERIAL

FIELD OF THE INVENTION

The present invention relates to a heat developable color light-sensitive material for an image forming process comprising separately providing the heat developable color light-sensitive material (hereinafter occasionally referred to as a "light-sensitive element") and a dye fixing element on different supports, respectively, superposing one on another and transferring a diffusible dye from the heat developable color light-sensitive material to the dye fixing element, to thereby form an image. The heat developable color light-sensitive materials as used herein comprises at least a light-sensitive silver halide and dye-donating compounds. Images obtained by the heat developable color light-sensitive material of the present invention and a dye fixing element are mainly used as color proofs in the printing field.

BACKGROUND OF THE INVENTION

The heat developable light-sensitive materials are known in the art, and the heat developable light-sensitive materials and processes using the same are described, for example, in *Shashin Kohqaku no Kiso* (*Higinen Shashin*) (The Fundamentals of Photographic Engineering (Nonsilver Salt Photograph), pages 242 to 255 (1982), Corona Publishing Co. Ltd. and U.S. Pat. No. 4,500,626.

In addition, methods for forming dye images, for example, by the coupling reaction of oxides of developing agents and couplers are described in U.S. Pat. Nos. 3,761,270 and 4,021,240. Further, methods for forming positive color images by the light-sensitive silver dye bleaching process are described in U.S. Pat. No. 4,235,957 and the like.

Furthermore, a method has recently been proposed in which a diffusible dye is released or formed imagewise by heat development and the diffusible dye is transferred onto a dye fixing element. According to this method, either a negative dye image or a positive dye image can be obtained by changing the kind of dye-donating compound used or the kind of silver halide used. Further details thereof are described in U.S. Pat. Nos. 4,500,626, 4,483,914, 4,503,137 and 4,559,290, JP-A-58-149046 (the term "JP-A" as used herein means an "unexamined published Japanese patent application"), JP-A-60-133449, JP-A-59-218443, JP-A-61-238056, EP-A-220,746, JIII Journal of Technical Disclosure No. 87-6199 and EP-A-210,660.

Conventional color light-sensitive materials usually have spectral sensitization of blue, green and red, and color CRTs (cathode ray tubes) are generally used as exposure light sources for obtaining images on such color light-sensitive materials by use of image information once converted to electric signals. However, the CRTs are unsuitable to obtain large-sized prints.

Further, light emitting diodes (LEDs) and semiconductor lasers (LDs) has been developed as writing heads which is capable of providing large-sized prints. However, no writing head has been developed yet which efficiently emits a blue light.

Accordingly, for example, when LEDs are used, a color light-sensitive material having three layers spectrally sensitized to near infrared, red and yellow is required to be exposed by a light source in which 3 LEDs of near infrared (800 nm), red (670 nm) and yellow (570 nm) are combined. A system for recording images by such constitution is described in *Nikkei New Material*, pages 47 to 57, Sep. 14, 1987, and partly comes in practice.

JP-A-61-137149 discloses a system for recording on a color light-sensitive material having 3 light-sensitive layers with a light source in which 3 LDs exhibiting light emission at 880 nm, 820 nm and 760 nm are combined, the light-sensitive layers each having spectral sensitization at each the wavelengths.

In general, when 3 kinds of spectral regions different from one another are each sensitized with yellow, magenta and cyan colors, respectively, to develop colors in a multilayer color light-sensitive material, it is an important technique in terms of color reproduction to develop each color without color mixture. In particular, use of LEDs or LDs as an exposure light source causes to have no choice but to design 3 spectral sensitivities in a narrow spectral region (a region from near infrared to infrared), and it becomes a key for improving color separation how to decrease the overlap of the respective spectral sensitivities.

In order to ensure color separation, techniques such as a successive increase in sensitivity in the short-wavelength side and provision of a filter layer are known as described in U.S. Pat. No. 4,619,892. However, the successive increase in sensitivity in the short-wavelength side has the disadvantages of causing an increase in fog and deteriorating raw stock aging stability. In infrared sensitization, it has been difficult to attain high sensitivity because of desensitization and low color sensitization efficiency caused by addition of dyes.

Color light-sensitive materials excellent in color separation, high in sensitivity and good in raw stock aging stability are described in JP-A-4-146431 and JP-A-5-45828, in which J-band type infrared sensitizing dyes having sharp spectral sensitivity are used for overcoming these disadvantages.

The heat developable color light-sensitive materials as described above are used in combination with dye fixing elements mordanting diffusible dyes. When images obtained by this image forming process are used as color proofs in the printing field, a color reproduction region of images obtained by the synthesis of color images of three colors of yellow, magenta and cyan becomes an important factor. Namely, it is necessary to be able to cover a region similar to or more than that of images obtained by use of standard printing ink.

When an image is formed with dyes of three colors of yellow, magenta and cyan, it is important to use dyes having little subsidiary absorption in their hue for obtaining a good color reproduction region. The dyes having weak subsidiary absorption show the tendency that main absorption itself uniformly becomes sharp. Accordingly, the use thereof raises the problem that the maximum image density (hereinafter referred to as Dmax) decreases, or that black obtained as a synthesized image of the three colors changes in appearance according to the kind of a light source used, namely the light source dependency deteriorates.

SUMMARY OF THE INVENTION

An object of the present invention is to form an image having a color slightly different from that of an image obtained using standard printing ink, and having sufficient Dmax and excellent light source dependency, in an image forming process comprising separately providing a heat developable color light-sensitive material and a dye fixing element on different supports, respectively, superposing one on another and transferring a diffusible dye from the heat developable color light-sensitive material to the dye fixing element, to thereby form an image.

Other objects and effects of the present invention will be apparent from the following description.

The above described objects of the present invention have been achieved by providing:

i) a heat developable color light-sensitive material provided on a support, which is for use in an image forming process comprising using a dye fixing element which is provided on a support separate from the support for the light-sensitive material, superposing one on another, heat developing to form a diffusible dye in the light sensitive material, and transferring the diffusible dye to the dye fixing element to form an image, which light sensitive material comprises at least a light-sensitive silver halide and dye-donating compounds, and forms or releases diffusible yellow, magenta and cyan dyes by the heat development, the diffusible cyan dye comprising one or more cyan dyes, the yellow dye showing the maximum absorption intensity in spectral absorption at a wavelength of from 440 nm to 460 nm, the magenta dye showing the maximum absorption intensity in spectral absorption at a wavelength of from 525 nm to 545 nm, the cyan dye showing the maximum absorption intensity in spectral absorption at a wavelength of from 610 nm to 640 nm, and the absorption intensity of the cyan dye satisfying the following requirements (1) to (3):

(1) the wavelength ($\lambda C(10\%-)$) at which an absorption intensity in the short-wavelength side of the cyan dye reaches 10% of a peak absorption intensity is 525 nm to 545 nm;

(2) the wavelength ($\lambda C(10\%+)$) at which an absorption intensity in the long-wavelength side of the cyan dye reaches 10% of a peak absorption intensity is 690 nm or more; and (3) the difference between $\lambda C(10\%+)$ and $\lambda C(10\%-)$ ($\lambda C(10\%+)-\lambda C(10\%-)$) is 155 nm or more;

ii) the heat developable color light-sensitive material as described in the above i), wherein the light sensitive material contains one of a slightly soluble metal compound and a compound which forms a complex with a metal ion constituting the slightly soluble metal compound, and the dye fixing element contains the other compound, to thereby undergo a two-component reaction to form an alkali necessary for the development of the silver halide;

iii) the heat developable color light-sensitive material as described in the above i) or ii), wherein the dye-donating compound for a cyan diffusible dye comprises at least one azonaphthol or azophenol compound.

DETAILED DESCRIPTION OF THE INVENTION

In the heat developable color light-sensitive material of the present invention, there are regulations regarding the absorption wavelengths of the dyes released or formed from the yellow, magenta and cyan dye-donating compounds. This is because the peak wavelengths of three colors of the yellow, magenta and cyan dyes and the foot absorption in the short-wavelength side of cyan are important. In particular, the foot absorption of cyan has an influence on the color reproduction of pure cyan and green. The absorption, the hue and the spectral absorption of the yellow, magenta and cyan dyes as used herein means those in the state in which each dye is fixed to the dye fixing element.

On the other hand, of the three colors of yellow, magenta and cyan, the hue of cyan particularly has an influence on Dmax of an image to be obtained and the light source dependency. For example, of the absorption of the cyan dye, particularly, weak absorption in the long-wavelength region of 680 nm or more raises the problem that Dmax of an image obtained by cyan alone or by synthesis of cyan and another dye image is decreased. Weak absorption in the long-wavelength side of cyan further causes the phenomenon that the appearance of gray changes according to the kind of a lighting light source, namely deterioration of the light source dependency.

In the present invention, the foot absorption in the long-wavelength side of cyan and the width of absorption of cyan are regulated as effective means for solving both the problems of Dmax and the light source dependency.

The dye-donating compounds contained in the heat developable color light-sensitive material of the present invention are limited in their structure itself to some extent, because dyes released in heat development are required to be rapidly diffused into the dye fixing element. For example, in the case of cyan dye-donating compounds, phthalocyanine dyes exhibiting weak subsidiary absorption and a sharp absorption in the short-wavelength side are well known as cyan dyes. However, they are unsuitable for the heat developable color light-sensitive material in which the transferring properties are important, because of their high molecular weight. Accordingly, azonaphthol compounds, azophenol compounds or pyrazole compounds as described below can be used as compounds satisfying both the transferring properties and the hue. However, these compounds suitable for heat development are characterized by sharp absorption of the dyes, namely narrow width of absorption, in many cases. This results from the feature inherent in their dye molecules that the molecular structure is less changed between the base state and the excited state of these dyes. The compounds characterized by sharp absorption of the dyes are frequently excellent in that the color purity becomes high, when absorption peaks of the respective dyes are within a desirable wavelength range. In particular, this is applicable to yellow and magenta in many cases. On the other hand, when the hue of cyan is sharp, it is advantageous with respect to the color purity. However, when a black image is formed with three colors of yellow, magenta and cyan, as in the heat developable color light-sensitive material of the present invention, the problems arise that the absorption of a long-wavelength area disappears to lose the balance of the black image (the cyan color seems to be insufficient), and that the appearance of black varies according to the kind of light source used for observation. For design of the optimum cyan color like the present invention, the width of absorption ($\lambda C(10\%+)-\lambda C(10\%-)$) is required to be 155 nm or more. The above-mentioned phthalocyanine dyes are sharp in absorption in the short-wavelength side and wide in the width of absorption, having rectangular absorption which is nearly ideal. However, they can not be used because of their high molecular weight as described above. On the other hand, a single cyan dye-donating compound for use in the heat developable color light-sensitive material of the present invention hardly attains the ideal rectangular absorption, and it is therefore effective to use two or more kinds of dye-donating compounds having sharper absorption than the phthalocyanine dyes in admixture as described below.

In order to realize the desirable width of absorption of cyan dyes in the cyan dye-donating compounds for use in the present invention, it is effective to use two or more kinds of cyan dye-donating compounds as a mixture thereof. In this case, although the cyan dye-donating compounds different from each other in peak wavelengths are used in admixture, it is required that the peak wavelength of the cyan dyes are indispensably within the optimum peak wavelength range of from 610 nm to 640 nm specified in the present invention. Specifically, when cyan dye-donating compound (3) (peak wavelength: 623 nm) and cyan dye-donating compound (2) (peak wavelength: 660 nm) shown below are used in admixture, it is preferred to use them at a mixing ratio of cyan dye-donating compound (3) to cyan dye-donating compound (2) ranging from 8:2 to 6:4. When the dyes are mixed, λC(10%−) and λC(10%+) each indicates absorption values in the state in which the mixed dyes are fixed to the dye fixing element.

Although the structural formulas of the cyan dye-donating compounds for use in the present invention are shown in pages 42 to 46, these compounds are preferably used in admixture for the above-mentioned reason. When a dye-donating compound having an absorption peak in the short-wavelength side and a dye-donating compound having an absorption peak in the long-wavelength side are used as a mixture, combinations of a compound having a peak wavelength of 630 nm or less and a compound having a peak wavelength of 650 nm or more are preferred. The peak wavelengths of the exemplified compounds are shown at the right side of the structural formulas shown below. Further, in the present invention, it has been found that the azonaphthol cyan dye-donating compounds shown in pages 43 to 46 are particularly suitable as dyes having absorption peaks in the short-wavelength side, which have weak subsidiary absorption and a sharp foot end in the short-wavelength side, to be most suitably used for proof materials.

The dye fixing element for use in the present invention is used as an image receiving material in a process comprising forming or releasing diffusible dyes as a result of development of a light-sensitive silver halide in a photographic material using the silver halide, and transferring the diffusible dyes to the image receiving material to obtain images.

This image forming process is roughly divided into a so-called wet color diffusion transfer system in which development is conducted using processing solutions at ordinary temperatures and a heat development diffusion transfer system in which development is conducted by heat development. The dye fixing element of the present invention can be used in both of them as a suitable image receiving material.

In particular, the dye fixing element of the present invention is preferably used in the heat development diffusion transfer system. Accordingly, this system is described in detail below. However, the description of this system can be applied in common with the wet color diffusion transfer system, except for parts particular to heat development, such as organic silver salts and developing systems.

The heat developable color light-sensitive material for use in the present invention fundamentally comprises a support having provided thereon a light-sensitive silver halide, a binder and dye-donating compounds (in some cases, reducing agents serve therefor as described below), and can further contain an organic metal salt oxidizing agent as needed. These components are added to the same layer in many cases, but can also be separately added to different layers as long as they are in the reactable state. For example, a reduction in sensitivity can be prevented by allowing a colored dye-donating compound to exist in a layer under a silver halide emulsion. The reducing agent is preferably contained in the heat developable color light-sensitive material. However, it may be supplied from the outside, for example, by the method given below in which it is allowed to diffuse from the dye fixing element. The effect of enhancing the color image formation can be obtained by incorporating the reducing agent in the light-sensitive material.

In order to obtain a wide range of colors in the chromaticity diagram by use of the three primary colors of yellow, magenta and cyan, at least three silver halide emulsion layers each having sensitivity in a different spectrum region are used in combination. For example, there is a combination of the three layers of a blue-sensitive layer, a green-sensitive layer and a infrared-sensitive layer, a combination of a green-sensitive layer, a red-sensitive layer and an infrared-sensitive layer, or a combination of a red-sensitive layer, a first infrared-sensitive layer and a second infrared-sensitive layer. They are described, for example, in JP-A-59-180550, JP-A-64-13546, JP-A-62-253159 and EP-A-479,167. The respective light-sensitive layers can be arranged in the various orders known in color light-sensitive materials of the ordinary type. These light-sensitive layers may each be divided into two or more layers as needed. These respective light-sensitive layers are described in JP-A-1-252954. The kind of dye-donating compound (yellow, magenta or cyan) combined with each of these light-sensitive layers may be any when color images are reproduced from image information converted to electric signals like the present invention, and does not have such a restriction as placed on the color light-sensitive materials of the ordinary type.

The heat developable color light-sensitive material may be provided with various light-insensitive layers such as a protective layer, an undercoat layer, an intermediate layer, a yellow filter layer and an antihalation layer between the above-mentioned silver halide emulsion layers, as the uppermost layer or as the lowermost layer. Further, the heat developable color light-sensitive material may be provided with various supplementary layers such as a back layer on the opposite side of the support.

Specifically, the layer constitution as described in the above-mentioned patents can be employed, and the heat developable color light-sensitive materials can be provided with the undercoat layers as described in U.S. Pat. No. 5,051,335, the intermediate layers containing solid pigments as described in JP-A-1-167838 and JP-A-61-20943, the intermediate layers containing reducing agents or DIR compounds as described in JP-A-1-120553, JP-A-5-34884 and JP-A-2-64634, the intermediate layers containing electron transfer agents as described in U.S. Pat. Nos. 5,017,454 and 5,139,919 and JP-A-2-235044, the protective layers containing reducing agents as described in JP-A-4-249245 or combined layers thereof.

It is preferred that the support is designed so as to have an antistatic function to have a surface resistivity of $10^{12}$ Ω·cm or less.

When the images obtained from the heat developable color light-sensitive material and the dye fixing element as described above are used as a color proof for printing, no difference in color between the images and prints obtained from printing ink is desired. No difference in color is based on the assumption that a color reproduction region of the images obtained from the heat developable color light-sensitive material and the dye fixing element is wider than that of images obtained from printing ink. The color reproduction region means color reproduction over all lightness regions.

As a factor determining the color reproduction region of the images obtained from the heat developable color light-sensitive material and the dye fixing element, the hue of three color dyes of yellow, magenta and cyan, four color dyes further including black, or mixed dyes thereof is important. However, the coloration of white background areas of the images also have an important influence thereon.

The white background of the images obtained by heat development is determined by the white grounds of the dye fixing element itself, the coloration of components transferred from the heat developable color light-sensitive material in heat development and the coloration of components colored by heating if such components exist. Of these, the white ground of the dye fixing element itself is an important factor.

The white ground of the dye fixing element itself is determined by the coloration of a support, a dye fixing layer, a protective layer provided on or under the dye fixing layer and an intermediate layer. Accordingly, how to design the color of these respective constituents becomes important.

Methods for adjusting the white ground of the dye fixing element itself include method of adding coloring components such as pigments and dyes to the supports, the dye fixing layers, the protective layers provided on or under the dye fixing layers and the intermediate layers. When a paper support laminated with polyethylene on both surfaces is used as the support, specific examples thereof include a method of adding a white pigment such as titanium oxide or magnesium oxide, or a blue pigment such as ultramarine to the paper support or the laminate layers. In addition to the coloring components, a fluorescent brightening agent may be added.

In order to improve the S/N ratio of the images obtained from the heat developable color light-sensitive material and the dye fixing element, materials are suitable which produce alkali only in heat development and are neutral during storage of the materials before or after image formation. A two-component reaction of a slightly soluble metal compound and a compound (referred to as complex-formable compounds) which forms a complex with the metal ion constituting the slightly soluble metal compound is suitable for this purpose (this alkali producing method is described in EP-A-210,660 and U.S. Pat. No. 4,740,445).

Specific means for designing the above-mentioned materials are described below.

First, a silver halide emulsion for use in the heat developable color light-sensitive material of the present invention is described in detail below.

The silver halide emulsion which can be used in the present invention may be any of silver chloride, silver bromide, silver iodobromide, silver chlorobromide, silver chloroiodide and silver chloroiodobromide.

The silver halide emulsion for use in the present invention may be either surface latent image type emulsion or internal latent image type emulsion. The internal latent image type emulsions are used as direct reversal emulsions in combination with nucleating agents or light fogging. Further, they may be so-called core/shell emulsions in which the insides of grains are different from the surfaces thereof in the phase, and silver halides different in composition may be joined by epitaxial junction. The silver halide emulsions may be either monodisperse emulsions or polydisperse emulsions, and methods are preferably used in which monodisperse emulsions are mixed to adjust gradation as described in JP-A-1-167743 and JP-A-4-223463. The grain size is preferably 0.1 $\mu$m to 2 $\mu$m, and more preferably 0.2 $\mu$m to 1.5 $\mu$m. The silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, any of silver halide emulsions can be used which are prepared by methods described in U.S. Pat. No. 4,500,626, column 50, U.S. Pat. No. 4,628,021, Research Disclosure (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

In the course of preparation of the light-sensitive silver halide emulsion of the present invention, so-called salt removal for removing excess salts is preferably conducted. As means for this, water washing with noodle may be used which is conducted by gelation of gelatin, and precipitation methods may also be used utilizing multiply charged anionic inorganic salts (for example, sodium sulfate), anionic surfactants, anionic polymers (for example, polysodium styrenesulfonate) or gelatin derivatives (for example, aliphatic acylated gelatin, aromatic acylated gelatin and aromatic carbamoylated gelatin). The precipitation methods are preferably used.

For various purposes, the light-sensitive silver halide emulsion may contain a compound of a heavy metal such as iridium, rhodium, platinum, cadmium, zinc, thallium, lead, iron and osmium. These compounds may be used alone or in combination. The amount added is generally about $10^{-9}$ to $10^{-3}$ mol per mol of silver halide, although it depends on the purpose of use. They may be uniformly added to grains or localized in the insides or surfaces of grains. Specifically, emulsions described in JP-A-2-236542, JP-A-1-116637 and JP-A-5-181246 are preferably used.

In the grain forming stage of the light-sensitive silver halide emulsion of the present invention, rhodanides, ammonia, 4-substituted thioether compounds, organic thioether derivatives described in JP-B-47-11386 (the term "JP-B" as used herein means an "examined Japanese patent publication") or sulfur-containing compounds described in JP-A-53-144319 can be used as solvents for silver halides.

For other conditions, reference can be made to the descriptions of P. Glafkides, *Chemie et Phisigue Photographigue* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. That is, any of an acid process, a neutral process and an ammonia process may be used. A soluble silver salt and a soluble halogen salt may be reacted with each other by using any of a single jet process, a double jet process and a combination thereof. In order to obtain monodisperse emulsions, the double jet process is preferably used.

A reverse mixing process in which grains are formed in the presence of excess silver ions can also be used. As a type of double jet process, a process of maintaining the pAg in a liquid phase constant in which a silver halide is formed, namely a so-called controlled double jet process, can also be used.

In order to speed growth of grains, the concentration, the amount and the rate of silver salts and halogen salts added may be increased (JP-A-55-142329, JP-A-55-158124 and U.S. Pat. No. 3,650,757).

Reaction solutions may be stirred by any of the known stirring methods. The temperature and the pH of the reaction solutions during formation of silver halide grains may be arbitrarily established depending on the purpose. The pH range is preferably 2.2 to 8.5, and more preferably 2.5 to 7.5.

The light-sensitive silver halide emulsion is usually chemically sensitized. For chemical sensitization of the light-sensitive silver halide emulsions of the present invention, chalcogen sensitization such as sulfur sensitization, selenium sensitization or tellurium sensitization, noble metal sensitization using gold, platinum, palladium, etc. and reduction sensitization can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant described below can be added after chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsion for use in the present invention is preferably 1 $mg/m^2$ to 10 $g/m^2$ in terms of silver.

In order to give the color sensitivities of green, red and infrared sensitivities to the light-sensitive silver halide emulsion for use in the present invention, the light-sensitive silver halide emulsion is generally spectrally sensitized with methine dyes or the like. Further, spectral sensitization of a blue region may be applied to blue-sensitive emulsions as needed.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for supersensitization and wavelength adjustment of spectral sensitivity.

The emulsion may contain dyes having no color sensitization themselves or compounds which do not substantially absorb visible light and exhibit supersensitization, in combination with the sensitizing dyes (for example, those described in U.S. Pat. No. 3,615,613 and JP-A-63-23145).

These sensitizing dyes may be added to the emulsions during chemical ripening, before or after it, or before or after nucleation of the silver halide grains according to U.S. Pat. Nos. 4,183,756 and 4,225,666. These sensitizing dyes and supersensitizers may be added as solutions in organic solvents such as methanol, dispersions in gelatin or solutions in surfactants. The sensitizing agents are generally added in an amount of about $10^{-8}$ mol to about $10^{-2}$ mol per mol of silver halide.

Additives for use in such processes and known photographic additives which can be used in the heat developable color light-sensitive materials and the dye fixing elements of the present invention are described in RD, No. 17643, ibid., No. 18716 and ibid., No. 307105 described above and corresponding portions thereof are summarized in the following table.

| Type of Additives | RD17643 | RD18716 | RD307105 |
|---|---|---|---|
| 1. Chemical Sensitizers | p. 23 | p. 648, right column | p. 866 |
| 2. Sensitivity Increasing Agents | | p.648, right column | |
| 3. Spectral Sensitizers, Supersensitizers | pp. 23–24 | p. 648, right column to p. 649, right column | pp. 866–868 |
| 4. Fluorescent Brightening Agents | p. 24 | p. 648, right column | p. 868 |
| 5. Antifoggants, Stabilizers | pp. 24–25 | p. 649, right column | pp. 868–870 |
| 6. Light Absorbers, Filter dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matte Agents | | | pp. 878–879 |

As the binder for the layers constituting the heat developable color light-sensitive material and the dye fixing element, hydrophilic binders are preferably used. Examples thereof include the binders described in Research Disclosures stated above and JP-A-64-13546, pages 71 to 75. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, examples of the binders which can be used also include high water-absorptive polymers described in U.S. Pat. No. 4,960,681 and JP-A-62-245260, namely homopolymers of vinyl monomers having —COOM or —$SO_3M$ (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.). These binders can be used in combination. In particular, combinations of gelatin and the above-mentioned binders are preferred. Gelatin is selected from lime-treated gelatin, acid-treated gelatin, so-called delimed gelatin reduced in content of calcium and the like, depending on various purposes, and they are also preferably used in combination.

When the system of supplying a trace amount of water to conduct heat development is employed, use of the above-mentioned high water-absorptive polymers makes it possible to rapidly absorb water. Apart from this invention, use of the high water-absorptive polymers in the dye fixing layers or the protective layers therefor permits prevention of retransfer of the dyes from the dye fixing elements to the others after transfer.

In the present invention, the amount of binders coated is preferably 20 $g/m^2$ or less, more preferably 10 $g/m^2$ or less, and most preferably 0.5 $g/m^2$ to 7 $g/m^2$ or less.

In the present invention, organic metal salts can also be used as oxidizing agents in combination with the light-sensitive silver halide emulsion. Of these organic metal salts, organic silver salts are particularly preferably used.

Organic compounds which can be used for formation of the above-mentioned organic silver salt oxidizing agents include benzotriazole compounds, fatty acids and other compounds described in U.S. Pat. No. 4,500,626, columns 52 and 53. Silver acetylide described in U.S. Pat. No. 4,775,613 is also useful. The organic silver salts may be used as a combination of two or more thereof.

The organic silver salts described above can be used in combination with the light-sensitive silver halides in an amount of 0.01 mol to 10 mol, preferably 0.01 mol to 1 mol, per mol of light-sensitive silver halide. The total amount of the light-sensitive silver halides and the organic silver salts coated is 0.05 $g/m^2$ to 10 $g/m^2$, and preferably 0.1 $g/m^2$ to 4 $g/m^2$, in terms of silver.

In the present invention, reducing agents known in the field of heat developable color light-sensitive materials can be used. Further, the reducing agents also include reductive dye-donating compounds described below (in this case, they can also be used in combination with other reducing agents). Furthermore, precursors of reducing agents can also be used which themselves have no reductive ability, but exhibit reductive ability by action of nucleophilic reagents or heat during the course of development.

Examples of the reducing agents for use in the present invention include reducing agents and precursors of reducing agents described in U.S. Pat. Nos. 4,500,626, columns 49 and 50, 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and EP-A-220,746, pages 78 to 96.

Combinations of various reducing agents as disclosed in U.S. Pat. No. 3,039,869 can also be used.

When nondiffusible reducing agents are used, electron transfer agents and/or precursors thereof can be used in combination to enhance electron transfer between the nondiffusible reducing agents and the silver halides if necessary. It is particularly preferred to use ones described in U.S. Pat. No. 5,139,919 given above, EP-A-418,743, JP-A-1-138556 and JP-A-3-102345. Further, methods for stably introducing them into layers as described in JP-A-2-230143 and JP-A-2-235044 are preferably used.

The electron transfer agents or the precursors thereof can be selected from the reducing agents or the precursors thereof described above. It is desirable that the electron transfer agents or the precursors thereof are higher in their mobility than the nondiffusible reducing agents (electron donors). Particularly useful electron transfer agents are 1-phenyl-3-pyrazolidone derivatives and aminophenol derivatives.

The nondiffusible reducing agents (electron donors) for use in combination with the electron transfer agents may be any of the above-mentioned reducing agents, as long as they do not substantially move in the layers of the light-sensitive materials. Preferred examples thereof include hydroquinone derivatives, sulfonamidophenols, sulfonamidonaphthols, compounds described in JP-A-53-110827, U.S. Pat. Nos. 5,032,487, 5,026,634 and 4,839,272 as electron donors, and nondiffusible reductive dye-donating compounds described below.

Further, precursors of electron donors as described in JP-A-3-160443 are also preferably used.

Furthermore, for various purposes such as color mixture prevention, improvement in color reproduction, improvement in white grounds and prevention of silver transfer to dye fixing materials, the above-mentioned reducing agents can be used in intermediate layers or protective layers. Specifically, reducing agents described in EP-A-524,649, EP-A-357,040, JP-A-4-249245, JP-A-2-64633, JP-A-2-46450 and JP-A-63-186240 are preferably used. Further, reductive compounds releasing development inhibitors as described in JP-B-3-63733, JP-A-1-150135, JP-A-2-110557, JP-A-2-64634, JP-A-3-43735 and EP-A-451,833 are also used.

In the present invention, the total amount of the reducing agents added is preferably 0.01 mol to 20 mol, and more preferably 0.1 mol to 10 mol, per mol of silver.

In the present invention, silver can be used as an image forming substance. When silver ions are reduced to silver under high temperature conditions, compounds forming or releasing movable dyes corresponding to or reversely corresponding to this reaction, namely dye-donating compounds, can also be contained.

Examples of the dye-donating compounds available in the present invention include compounds forming dyes by the oxidation coupling reaction (couplers). The couplers may be either 4-equivalent couplers or 2-equivalent couplers. Further, 2-equivalent couplers having nondiffusible groups as removable groups and forming diffusible dyes by the oxidation coupling reaction are also preferred. The nondiffusible groups may be polymer chains. Examples of color developing agents and the couplers are described in detail in T. H. James, *The Theory of the Photographic Process*, the fourth edition, pages 291 to 334 and 354 to 361, RD, 307105, page 871, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Further examples of the dye-donating compound include compounds having the function of releasing or diffusing diffusible dyes imagewise. The compounds of this type can be represented by the following general formula (LI):

$$((\mathrm{Dye})_m\text{—}\mathrm{Y})_n\text{—}\mathrm{Z} \qquad \text{(LI)}$$

wherein Dye represents a dye group, a dye group temporarily shifted to a short wavelength, or a dye precursor group; Y represents only a bond or a bonding group; Z represents a group having the property of bringing about the difference in diffusibility of the compound represented by $((\mathrm{Dye})_m\text{—}\mathrm{Y})_n\text{—}\mathrm{Z}$ corresponding to or reversely corresponding to a light-sensitive silver salt having a latent image imagewise, or releasing $(\mathrm{Dye})_m\text{—}\mathrm{Y}$ to produce the difference in diffusibility between $(Dye)_m$—Y released and $((Dye)_m—Y)_n$—Z; m represents an integer of 1 to 5; n represents 1 or 2; and when m or n is not 1, the plurality of Dye's may be the same or different.

Specific examples of the dye-donating compounds represented by general formula (LI) include the following compounds of (1) to (5). The following compounds of (1) to (3) form diffusible dye images (positive dye images) in counter correspondence to the development of silver halides, and the following compounds of (4) and (5) form diffusible dye images (negative dye images) corresponding to the development of silver halides.

(1) Dye developing agents described in U.S. Pat. Nos. 3,134,764, 3,362,819, 3,597,200, 3,544,545 and 3,482,972 and JP-B-3-68387, in which hydroquinone developing agents and dye components are connected to each other. These dye developing agents are diffusible under alkaline conditions, but react with silver halides to become nondiffusible.

(2) As described in U.S. Pat. No. 4,503,137, nondiffusible compounds can also be used which release diffusible dyes under alkaline conditions, but react with silver halides to lose their capability. Examples thereof include compounds releasing diffusible dyes by the intermolecular nucleophilic substitution reaction described in U.S. Pat. No. 3,980,479, and compounds releasing diffusible dyes by the intermolecular rearrangement reaction of isooxazolone rings described in U.S. Pat. No. 4,199,354.

(3) As described in U.S. Pat. No. 4,559,290, EP-A-220,746, U.S. Pat. No. 4,783,396, JIII Journal of Technical Disclosure 87-6199 and JP-A-64-13546, nondiffusible compounds can also be used which react with reducing agents left unoxidized on development to release diffusible dyes.

Examples thereof include compounds releasing diffusible dyes by the intermolecular nucleophilic substitution reaction after reduction as described in U.S. Pat. Nos. 4,139,389 and 4,139,379, JP-A-59-185333 and JP-A-57-84453, compounds releasing diffusible dyes by the intermolecular electron migration reaction after reduction as described in U.S. Pat. No. 4,232,107, JP-A-59-101649, JP-A-61-88257 and RD, 24025 (1984), compounds releasing diffusible dyes by cleavage of single bonds after reduction as described in West German Patent 3,008,588A, JP-A-56-142530, U.S. Pat. Nos. 4,343,893 and 4,619,884, nitro compounds releasing diffusible dyes after electron acceptance as described in U.S. Pat. No. 4,450,223, and compounds releasing diffusible dyes after electron acceptance as described in U.S. Pat. No. 4,609,610.

Preferred examples thereof include compounds each having an N—X bond (wherein X represents an oxygen atom, a sulfur atom or a nitrogen atom) and an electron attractive group in one molecule as described in EP-A-220,746, JIII Journal of Technical Disclosure 87–6199, U.S. Pat. No. 4,783,396, JP-A-63-201653, JP-A-63-201654 and JP-A-64-13546, compounds each having an $SO_2$—X (wherein X has the same meaning as given above) and an electron attractive group in one molecule as described in JP-A-1-26842, compounds each having a PO—X bond (wherein X has the same meaning as given above) and an electron attractive group in one molecule as described in JP-A-63-271344, and compounds each having a C—X' bond (wherein X' has the same meaning as with X, or represents —$SO_2$—) and an electron attractive group in one molecule as described in JP-A-63-271341. Further, compounds described in JP-A-1-161237 and JP-A-1-161342 can also be utilized in which single bonds are cleaved by π bonds conjugated with electron acceptable groups after reduction to release diffusible dyes.

Of these, the compounds each having an N—X bond and an electron attractive group in one molecule are particularly preferred. Specific examples thereof include compounds (1) to (3), (7) to (10), (12), (13), (15), (23) to (26), (31), (32), (35), (36), (40), (41), (44), (53) to (59), (64) and (70) described in EP-A-220,746 or U.S. Pat. No. 4,783,396, compounds (11) to (23) described in JIII Journal of Technical Disclosure 87-6199, and compounds (1) to (84) described in JP-A-64-13546.

(4) Compounds (DDR couplers) which are couplers having diffusible dyes in removable groups and release the diffusible dyes by the reaction of reducing agents with oxides. Specific examples thereof include compounds described in British Patent 1,330,524, JP-B-48-39165, U.S. Pat. Nos. 3,443,940, 4,474,867 and 4,483,914.

(5) Compounds (DRR compounds) which are reductive to silver halides or organic silver salts and reduce them to release diffusible dyes. These compounds do not necessitate use of other reducing agents. There is therefore preferably no problem of image stains caused by oxidized degradation products of reducing agents. Typical examples thereof are described in U.S. Pat. Nos. 3,928,312, 4,053,312, 4,055,428 and 4,336,322, JP-A-59-65839, JP-A-59-69839, JP-A-53-3819, JP-A-51-104343, RD, 17465, U.S. Pat. Nos. 3,725,062, 3,728,113 and 3,443,939, JP-A-58-116537, JP-A-57-179840 and U.S. Pat. No. 4,500,626. Specific examples of the DRR compounds include compounds described in U.S. Pat. No. 4,500,626, columns 22 to 44, mentioned above. Compounds (1) to (3), (10) to (13), (16) to (19), (28) to (30), (33) to (35), (38) to (40) and (42) to (64) described in the above-mentioned U.S. Patent are preferred among others. Further, compounds described in U.S. Pat. No. 4,639,408, columns 37 to 39 are also useful. In addition, as dye-donating compounds other than the above-mentioned couplers and compounds represented by general formula [LI], it is also possible to use dye silver compounds in which organic silver salts and dyes are connected to each other (RD, May 1978, pages 54 to 58), azo dyes used in the heat development silver dye bleaching method (U.S. Pat. No. 4,235,957 and RD, April 1976, pages 30 to 32) and leuco dyes (U.S. Pat. Nos. 3,985,565 and 4,022,617).

Specific examples of the DRR compounds are enumerated below, but specific examples of the present invention are not limited thereto. Further, these DRR compounds may be used alone in each of yellow, magenta and cyan, or as a combination of two or more of them.

Yellow Dye-Donating Compounds
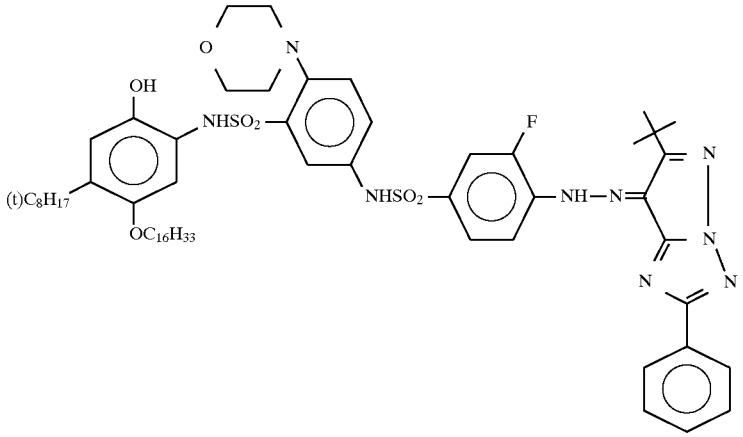
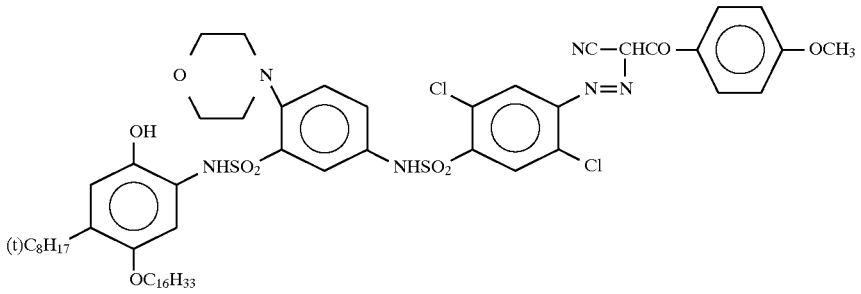
Magenta Dye-Donating Compounds
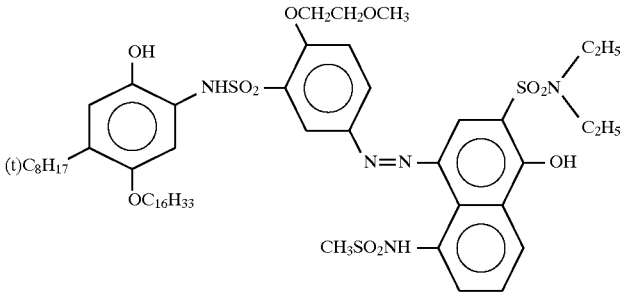
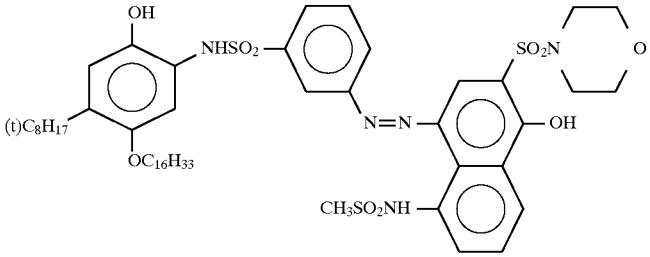

-continued
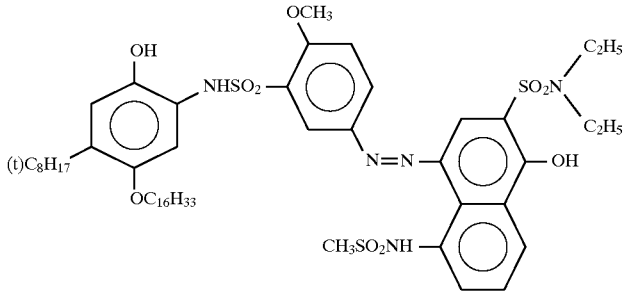
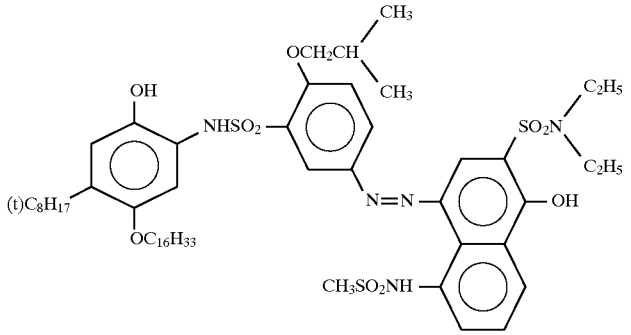
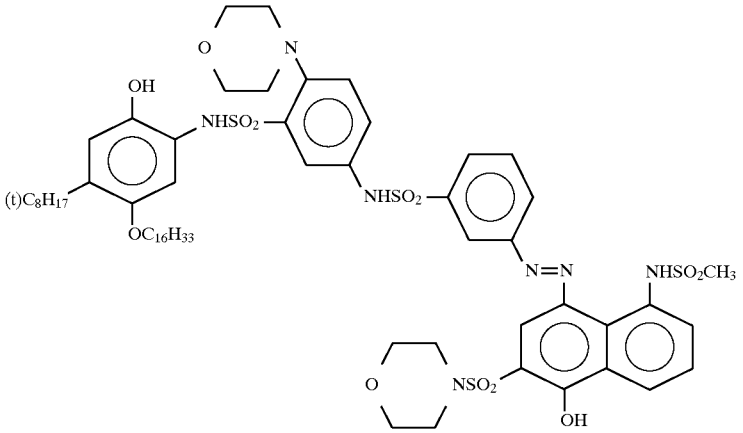
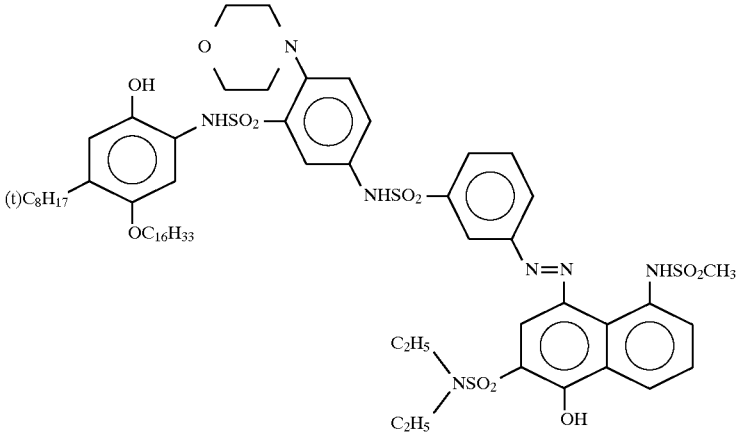

-continued
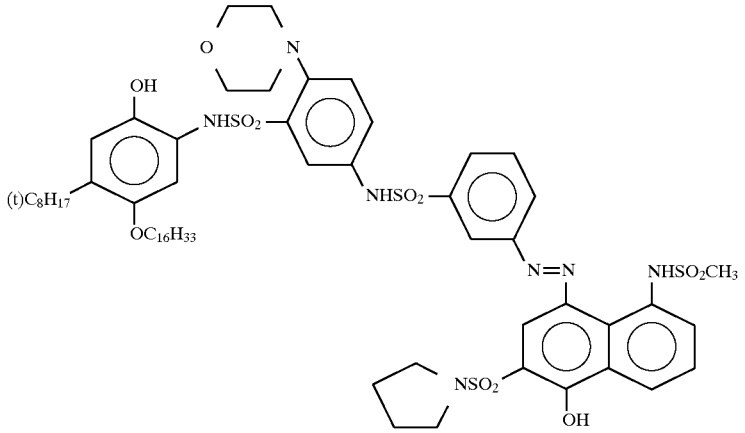
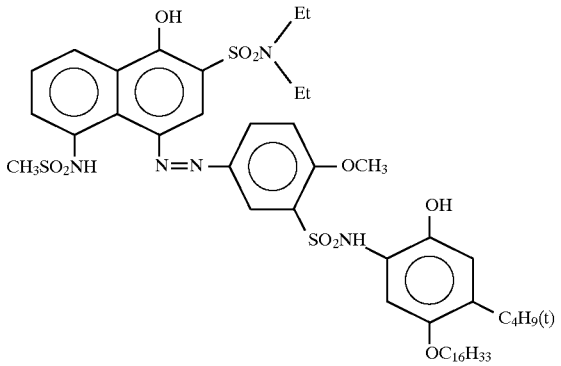
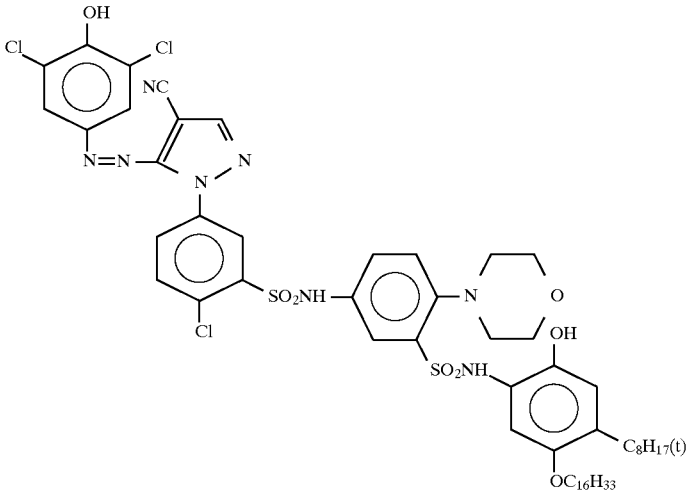

-continued
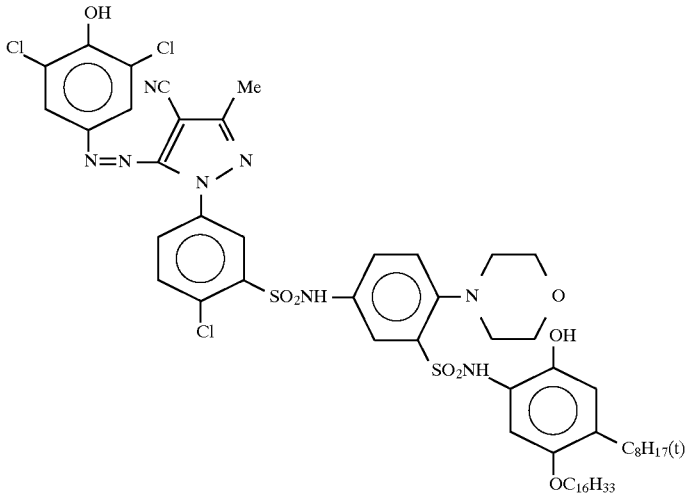
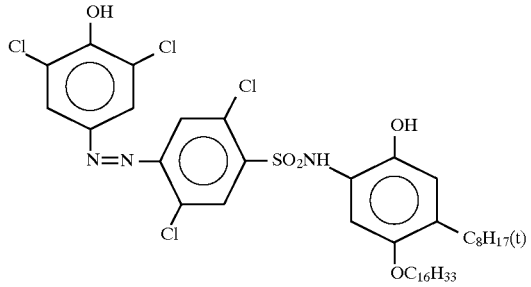
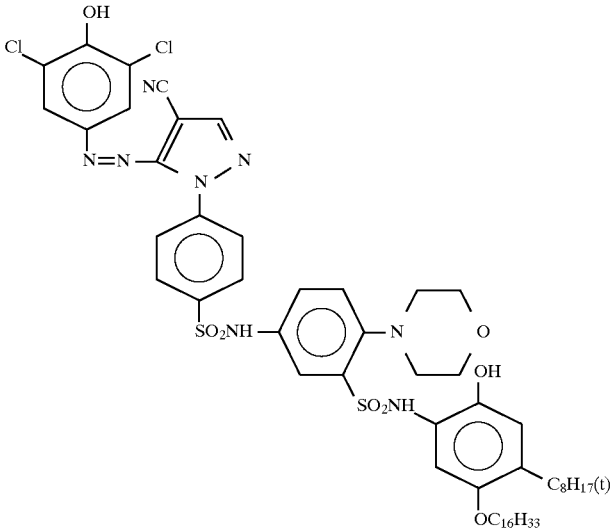

-continued
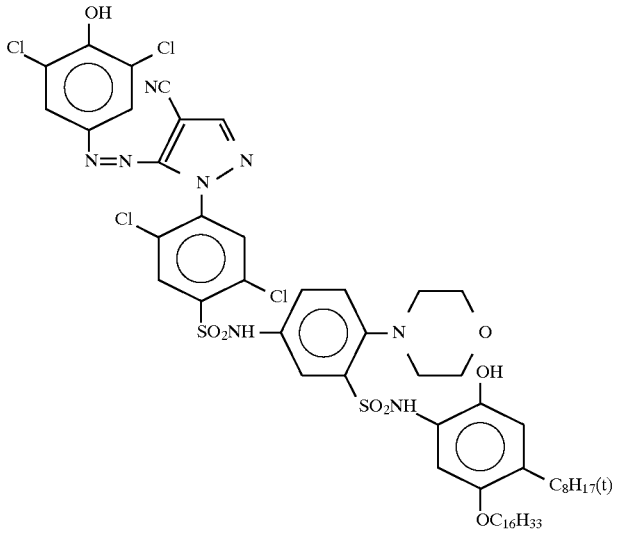
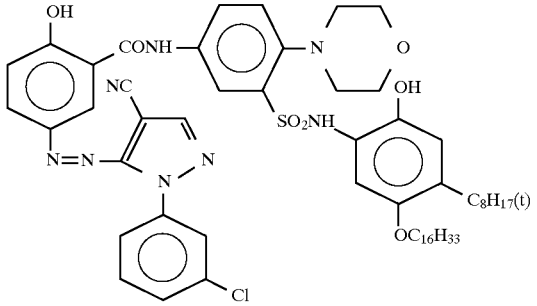
Cyan Dye-Donating Compounds
λmax: peak wavelength of absorption
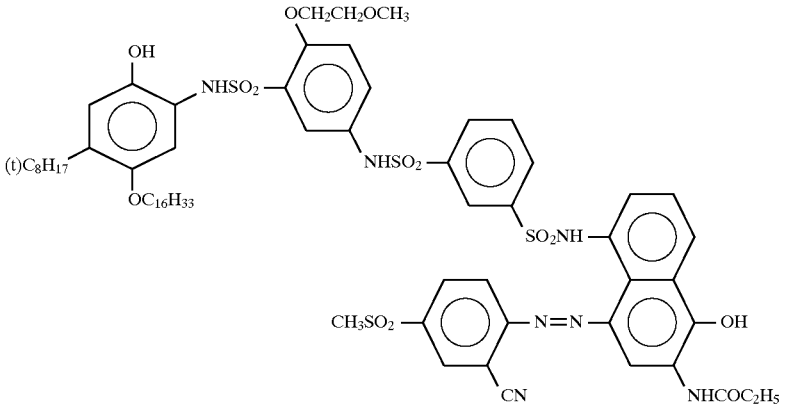
λmax = 623 nm -continued
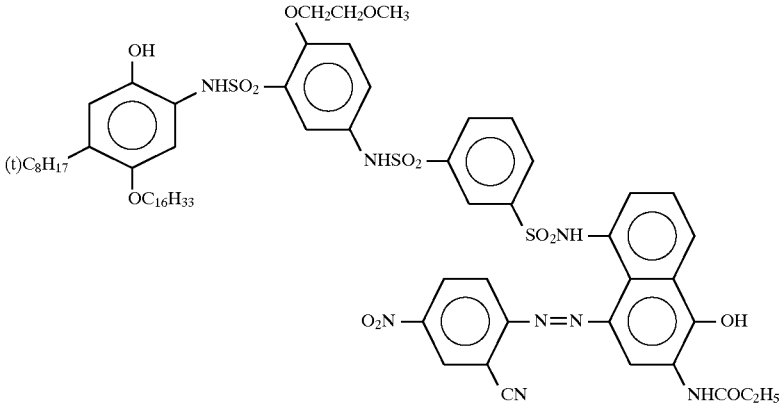
λmax = 660 nm
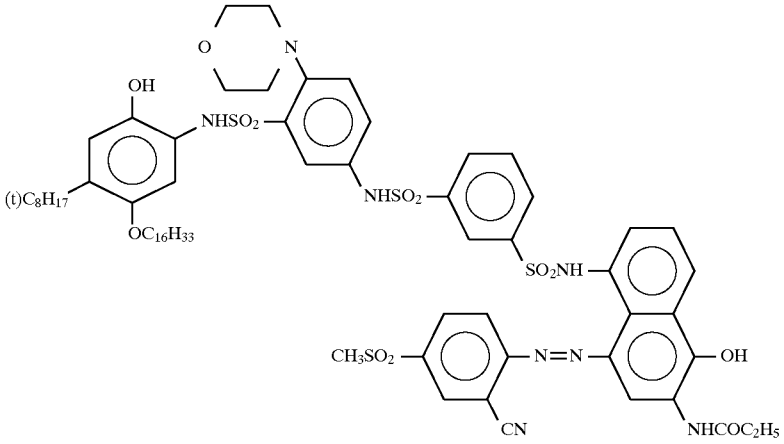
λmax = 623 nm
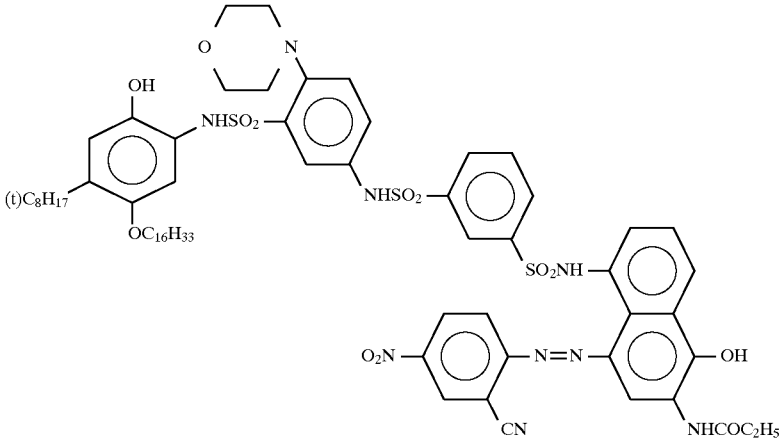
λmax = 660 nm
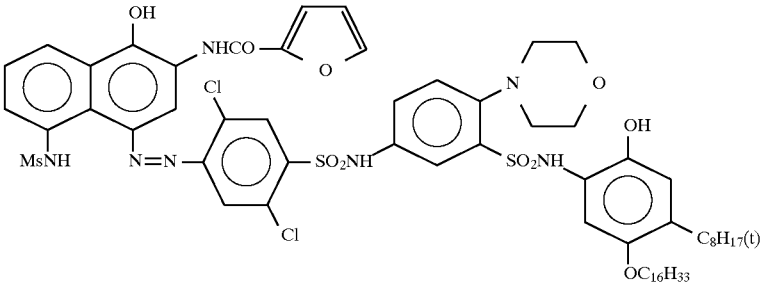
λmax = 632 nm -continued
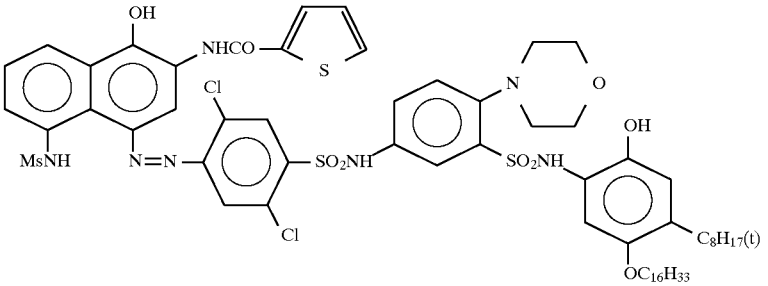
λmax = 632 nm
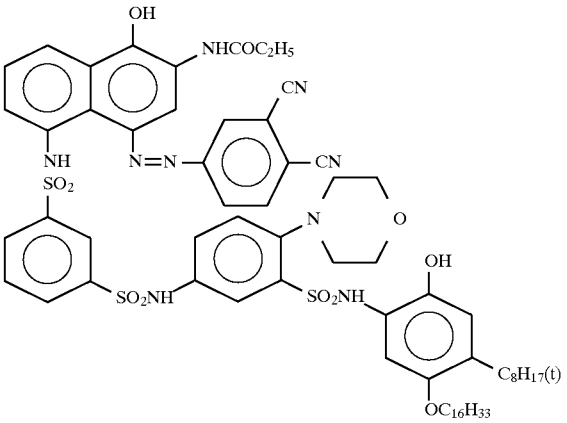
λmax = 628 nm
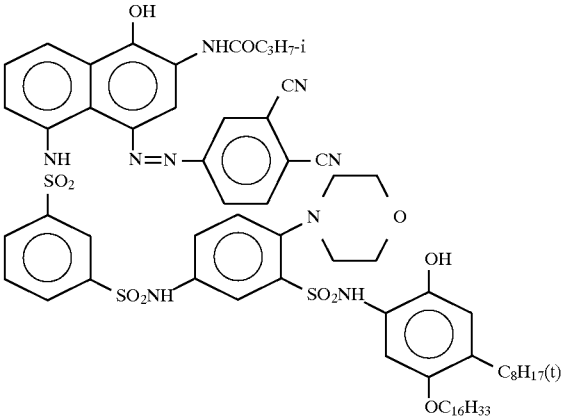
λmax = 629 nm
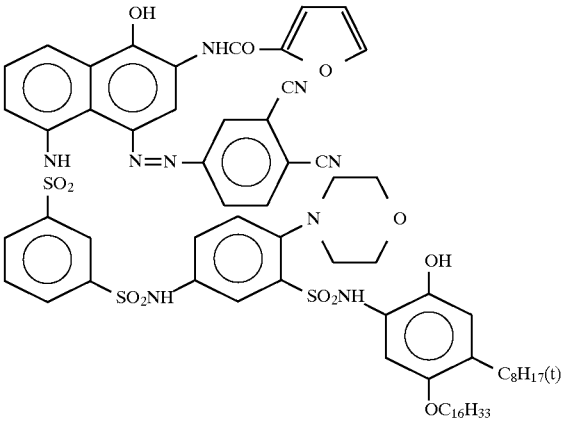
λmax = 633 nm -continued
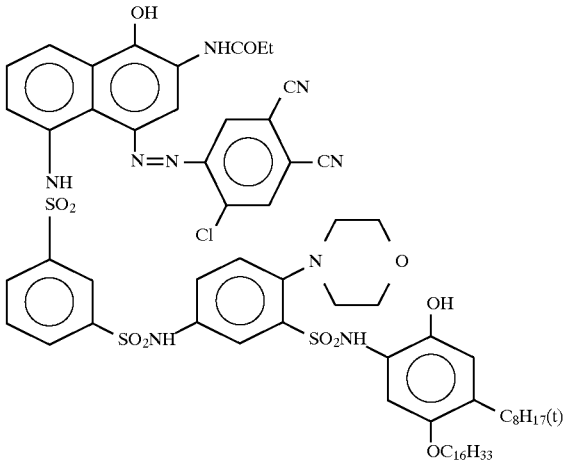
λmax = 627 nm
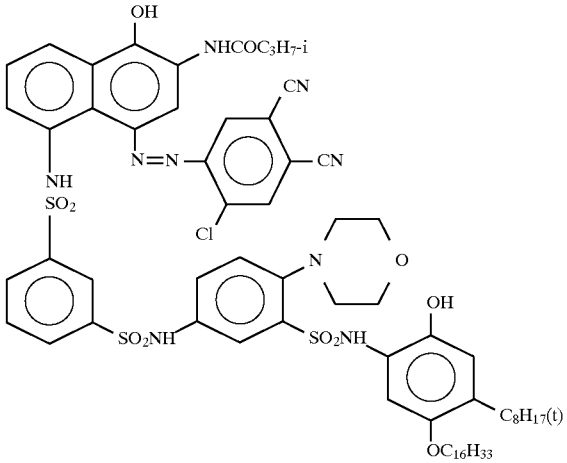
λmax = 627 nm
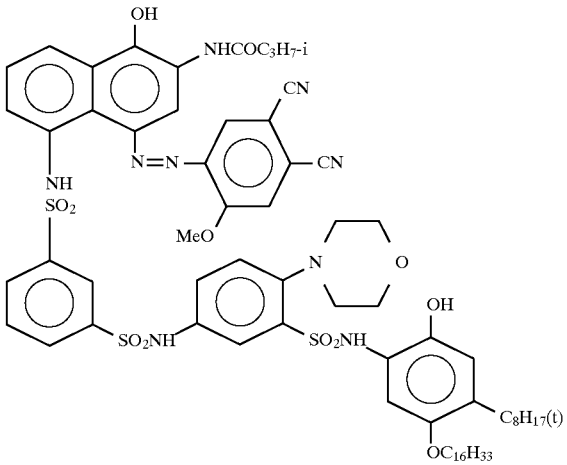
λmax = 627 nm -continued

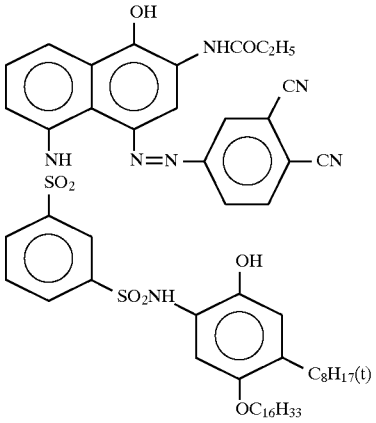

λmax = 632 nm

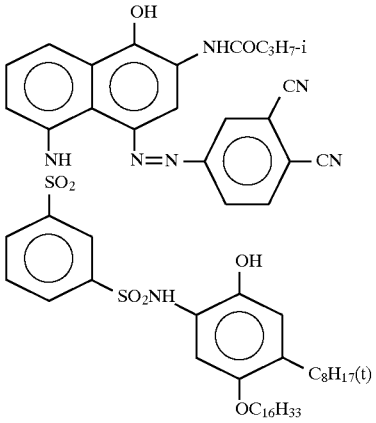

λmax = 628 nm

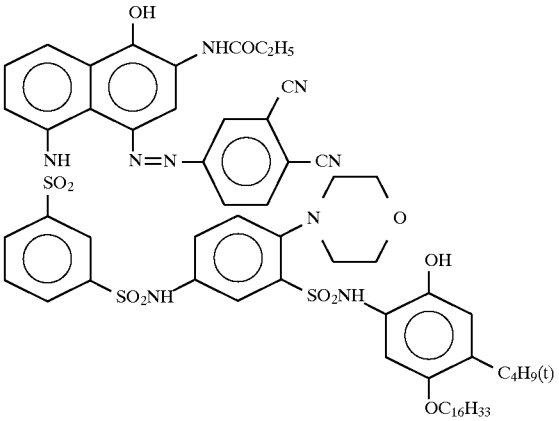

λmax = 628 nm

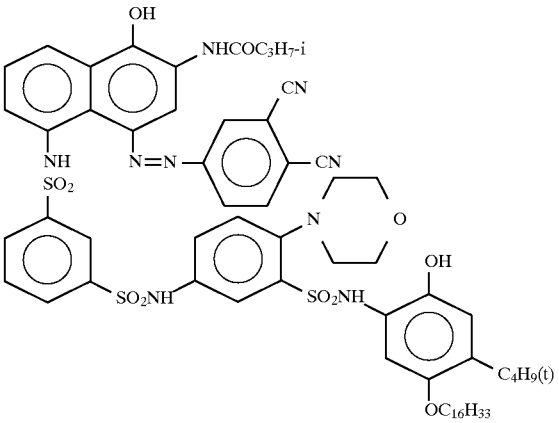

λmax = 629 nm

Hydrophobic additives such as the dye-donating compounds and the nondiffusible reducing agents can be introduced into the layers of the heat developable light-sensitive material by known methods such as methods described in U.S. Pat. No. 2,322,027. In this case, high boiling organic solvents as described in U.S. Pat. Nos. 4,555,470, 4,536,466, 4,536,467, 4,587,206, 4,555,476 and 4,599,296 and JP-B-3-62256 can be used in combination with low boiling organic solvents having a boiling point of 50° C. to 160° C. as needed. These dye-donating compounds, nondiffusible reducing agents and high boiling organic solvents can be used as a combination of two or more of them.

The amount of the high boiling organic solvents is 10 g or less, preferably 5 g or less, and more preferably 0.1 g to 1 g, per gram of dye-donating compound to be used. Further, it is 1 cc or less, preferably 0.5 cc or less, and more preferably 0.3 cc or less, per gram of binder.

Dispersing methods according to polymerized products described in JP-B-51-39853 and JP-A-51-59943, and methods of addition as fine grain dispersion described in JP-A-62-30242 can also be used.

Compounds substantially insoluble in water can be dispersed in binders as fine grains to add them to the layers, in addition to the above-mentioned methods.

When the hydrophobic compounds are dispersed in hydrophilic colloids, various surfactants can be used. For example, surfactants described in JP-A-59-157636, pages 37 and 38 and Research Disclosures stated above can be used.

Further, compounds for activating development and stabilizing images can be used in the heat developable color light-sensitive materials. Preferred examples of such compounds are described in U.S. Pat. No. 4,500,626, columns 51 and 52.

In the process for forming images by diffusion transfer of dyes, various compounds can be added to the layers constituting the heat developable color light-sensitive materials of the present invention for fixing or decoloring unnecessary dyes or colored products to improve white grounds of the images obtained.

Specifically, compounds described in EP-A-353,741, EP-A-461,416, JP-A-63-163345 and JP-A-62-203158 can be used.

Various pigments and dyes can be used in the layers constituting the heat developable color light-sensitive materials of the present invention for improving color separation and enhancing sensitivity.

Specifically, compounds described in Research Disclosures stated above, and compounds and layer constitution described in EP-A-479,167, EP-A-502,508, JP-A-1-167838, JP-A-4-343355, JP-A-2-168252, JP-A-61-20943, EP-A-479,167 and EP-A-502,508 can be used.

In the process for forming images by diffusion transfer of dyes, the dye fixing element is used together with the heat developable color light-sensitive material. The dye fixing element is separately provided on a support different from that for the light-sensitive material. For the mutual relations between the light-sensitive material and the dye fixing element, the relations to supports and the relations to white ground reflection layers, the relations described in U.S. Pat. No. 4,500,626, column 57 can also be applied to the present invention.

The dye fixing element preferably used in the present invention has at least one layer containing a mordant and a binder. As the mordants, those known in the field of photography can be used. Examples thereof include mordants described in U.S. Pat. No. 4,500,626, columns 58 and 59, JP-A-61-88256, pages 32 to 41, JP-A-1-161236, pages 4 to 7, U.S. Pat. Nos. 4,774,162, 4,619,883 and 4,594,308. Dye receiving polymer compounds as described in U.S. Pat. No. 4,463,079 may also be used.

In the dye fixing element for use in the present invention, the above-mentioned hydrophilic binders are preferably used. Further, carrageenan compounds as described in EP-A-443,529 and lattices having a glass transition temperature of 40° C. or less as described in JP-B-3-74820 are preferably used in combination.

The dye fixing element can be provided with supplementary layers such as a protective layer, a separation layer, an undercoat layer, an intermediate layer, a back layer and a curl prevention layer as needed. In particular, it is useful to provide the dye fixing element with a protective layer.

In the layers constituting the heat developable color light-sensitive material and the dye fixing element, high boiling organic solvents can be used as plasticizers, slipping agents or separation improvers of the light-sensitive material from the dye fixing element. Examples thereof include solvents described in Research Disclosures stated above and JP-A-62-245253.

Further, various silicone oils (all silicone oils including dimethylsilicone oils and modified silicone oils in which various organic groups are introduced into dimethylsiloxanes) can be used for the above-mentioned purposes. Effective examples thereof include various modified silicone oils described in *Modified Silicone Oils*, Technical Data P6-18B, published by Shinetsu Silicone Co., Ltd., particularly carboxy-modified silicone (trade name: X-22-3710).

Furthermore, silicone oils described in JP-A-62-215953 and JP-A-63-46449 are also effective.

Antifading agents may be used in the heat developable color light-sensitive material and the dye fixing element. Examples of the antifading agents include antioxidants, ultraviolet absorbers and certain metal complexes. Dye image stabilizers and ultraviolet absorbers described in Research Disclosures stated above are also useful.

The antioxidants include, for example, chroman compounds, coumaran compounds, phenol compounds (for example, hindered phenols), hydroquinone derivatives, hindered amine derivatives and spiroindan compounds. Compounds described in JP-A-61-159644 are also effective.

The ultraviolet absorbers include benzotriazole compounds (U.S. Pat. No. 3,533,794), 4-thiazolidone compounds (U.S. Pat. No. 3,352,681), benzophenone compounds (JP-A-46-2784), and compounds described in JP-A-54-48535, JP-A-62-136641 and JP-A-61-88256. Further, ultraviolet absorptive polymers described in JP-A-62-260152 are also effective.

The metal complexes include compounds described in U.S. Pat. Nos. 4,241,155, 4,245,018, columns 3 to 36, and 4,254,195, columns 3 to 8, JP-A-62-174741, JP-A-61-88256, pages 27 to 29, JP-A-63-199248, JP-A-1-75568 and JP-A-1-74272.

The antifading agent for preventing fading of a dye transferred to the dye fixing element may previously be added to the dye fixing element, or may be supplied from the outside such as the heat developable light-sensitive material or a transfer solvent described below to the dye fixing element.

The above-mentioned antioxidants, ultraviolet absorbers and metal complexes may be used in combination.

Fluorescent brighteners may be used in the heat developable color light-sensitive material and the dye fixing element. In particular, it is preferred that the fluorescent brightener is contained in the dye fixing element or supplied from the outside such as the heat developable light-sensitive material or the transfer solvent. Examples thereof include compounds described in *The Chemistry of Synthetic Dyes*, edited by K. Veenkataraman, vol. V, chapter 8 and JP-A-61-143752. More specifically, they include stilbene compounds, coumarin compounds, biphenyl compounds, benzoxazolyl compounds, naphthalimide compounds, pyrazoline compounds and carbostylyl compounds.

The fluorescent brighteners can be used in combination with the antifading agents or the ultraviolet absorbers.

Specific examples of these antifading agents, ultraviolet absorbers and fluorescent brighteners are described in JP-A-62-215272, pages 125 to 137, and JP-A-1-161236, pages 17 to 43.

Hardeners for use in the layers constituting the heat developable color light-sensitive material and the dye fixing element include hardeners described in Research Disclosures stated above, U.S. Pat. No. 4,678,739, column 41 and U.S. Pat. No. 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylenebis (vinylsulfonylacetamido)ethane), N-methylol hardeners (dimethylolurea) and polymer hardeners (compounds described in JP-A-62-234157).

These hardeners are used in an amount of 0.001 g to 1 g, preferably 0.005 g to 0.5 g, per g of gelatin coated, and may be added to any of the layers constituting the light-sensitive material and the dye fixing element. Further, they may be divided and added to two or more layers.

In the layers constituting the heat developable color light-sensitive material and the dye fixing element, various antifoggants, photographic stabilizers and precursors thereof can be used. Specific examples thereof include compounds described in Research Disclosures stated above, U.S. Pat. Nos. 5,089,378, 4,500,627 and 4,614,702, JP-A-64-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650 and RD, 17643 (1978), pages 24 and 25.

These compounds are used preferably in an amount of $5\times10^{-6}$ mol to $1\times10^{-1}$ mol per mol of silver, and more preferably in an amount of $5\times10^{-5}$ mol to $1\times10^{-2}$ mol per mol of silver.

In the layers constituting the heat developable color light-sensitive material and the dye fixing element, various surfactants can be used for assisting coating, improving separation, improving slipperiness, preventing electric charge and accelerating development. Examples of the surfactants are described in Research Disclosures stated above, JP-A-62-173463 and JP-A-62-183457.

The layers constituting the heat developable color light-sensitive material and the dye fixing element may contain organic fluoro compounds for improving slipperiness, preventing electric charge and improving separation. Typical examples of the organic fluoro compounds include fluorine surfactants described in JP-B-57-9053, columns 8 to 17, JP-A-61-20944 and JP-A-62-135826, and hydrophobic fluorine compounds such as oily fluorine compounds (for example, fluorine oils) and solid fluorine compounds (for example, ethylene tetrafluoride resins).

In the heat developable color light-sensitive material and the dye fixing element, matte agents can be used for preventing adhesion and improving slipperiness. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in Research Disclosures stated above can be used.

Besides, the layers constituting the heat developable color light-sensitive material and the dye fixing element may contain heat solvents, antifoaming agents, microbicidal antifungal agents and colloidal silica. Examples of these additives are described in JP-A-61-88256, pages 26 to 32, JP-A-3-11338 and JP-B-2-51496.

In the present invention, image formation accelerating agents can be used in the heat developable color light-sensitive material and/or the dye fixing element. The image formation accelerating agents have functions such as the acceleration of the redox reaction of the silver salt oxidizing agents and the reducing agents, the acceleration of a reaction such as the formation of dyes from the dye-donating substances, the degradation of dyes or the release of the diffusible dyes and the acceleration of the movement of dyes from the heat developable light-sensitive materials to the dye fixing elements, and can be classified into bases or base precursors, nucleophilic compounds, high boiling organic solvents (oils), heat solvents, surfactants, compounds having interaction with silver or silver ions, according to the physicochemical functions. However, these groups of substances generally have combined functions, and therefore, they have usually combinations of some of the above-mentioned acceleration effects. The details thereof are described in U.S. Pat. No. 4,678,739, columns 38 to 40.

The base precursors include salts of organic acids and bases which are decarobxylated by heat, and compounds releasing amines by the intermolecular nucleophilic substitution reaction, the Lossen rearrangement or the Beckmann rearrangement. Specific examples thereof are described in U.S. Pat. Nos. 4,514,493 and 4,657,848.

In a system in which heat development and dye transfer are concurrently performed in the presence of a small amount of water, it is preferred from the view point of the enhancement of keeping quality of the heat developable light-sensitive materials that the bases and/or the base precursors are allowed to be contained in the dye fixing element.

In addition to the above, combinations of a slightly soluble metal compound and a compound (referred to as a "complex-formable compound") which can form a complex with the metal ion constituting the slightly soluble metal compound as described in EP-A-210,660 and U.S. Pat. No. 4,740,445, and compounds generating bases by electrolysis as described in JP-A-61-232451 can also be used as the base precursor. In particular, the former is effective. It is preferred that the slightly soluble metal compound and the complex-formable compound are separately added such that one is incorporated into the heat developable light-sensitive material and the other into the dye fixing element.

In the present invention, in the heat developable color light-sensitive material and/or the dye fixing element, various development stoppers can be used for stably obtaining constant images against fluctuations in processing temperature and processing time on development.

The development stopper as used herein is a compound which, after appropriate development, rapidly neutralizes or reacts with a base to reduce the concentration of the base contained in a film, to thereby stop development, or a compound which interacts with silver and a silver salt to inhibit development. Examples thereof include acid precursors which release acids by heating, electrophilic compounds which conduct the replacement reaction with coexisting bases by heating, nitrogen-containing heterocyclic compounds, mercapto compounds and precursors thereof. More specifically, they are described in JP-A-62-253159, pages 31 and 32.

In the present invention, supports which can endure processing temperatures are used as the supports of the heat developable color light-sensitive material and the dye fixing element. In general, the supports include supports for photography such as the paper and synthetic polymers (films) described in *Shashin Kohqaku no Kiso* (Ginen Shashin) (The Fundamentals of Photographic Engineering (Silver Salt Photograph), pages 223 to 240 (1979), Corona Publishing Co. Ltd. Specifically, the supports used include polyethylene terephthalate, polyethylene naphthalate, polycarbonates, polyvinyl chloride, polystyrene, polypropylene, polyimides, cellulose derivatives (for example, cellulose triacetate), films thereof containing pigments such as titanium oxide, synthetic paper produced from polypropylene or the like by film methods, mixed paper produced from pulp of synthetic resins such as polyethylene and natural pulp, Yankee paper, baryta paper, coated paper (particularly, cast-coated paper), metals, cloth and glass.

They can be used alone or as supports laminated with synthetic polymers such as polyethylene on one side or both sides. The laminate layers can contain pigments such as titanium oxide, ultramarine and carbon black, or dyes, if necessary.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

Back surfaces of these supports may be coated with hydrophilic binders and semiconductive metal oxides such as alumina sols and tin oxide, or with antistatic agents such as carbon black. Specifically, supports described in JP-A-63-220246 can be used. Preferably, surfaces of the supports are variously treated or undercoated for improving adhesion to the hydrophilic binders.

Methods for exposing the heat developable color light-sensitive material to record an image include, for example, methods of directly taking landscape photographs or human subject photographs by use of cameras, methods of exposing the light-sensitive material through reversal films or negative films by use of printers or enlargers, methods of subjecting original pictures to scanning exposure through slits by use of exposing devices of copying machines, methods of allowing light emitting diodes or various lasers (such as laser diodes and gas lasers) to emit light by image information through electric signals to subject the light-sensitive materials to scanning exposure (methods described in JP-A-2-129625, and JP-A-5-176114, JP-A-5-199372, JP-A-6-127021), and methods of supplying image information to image displays such as CRTs, liquid crystal displays, electroluminescence displays and plasma displays to expose the light-sensitive materials directly or through optical systems.

As described above, light sources and exposing methods described in U.S. Pat. No. 4,500,626, column 56, JP-A-2-53378 and JP-A-2-54672, such as natural light, tungsten lamps, light emitting diodes, laser sources and CRT light sources, can be used to record an image on the heat developable color light-sensitive material.

Further, the image exposure can also be carried out using wavelength converting elements in which non-linear optical materials are combined with coherent light sources such as laser beams. Here, the non-linear optical material is a material which can express non-linearity between an electrical field and polarization appearing when a strong optical electrical field such as a laser beam is applied. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are useful.

Furthermore, image signals obtained from video cameras or electronic still cameras, television signals represented by the Nippon Television Signal Criteria (NTSC), image signals obtained by dividing original pictures into many picture elements with scanners and image signals produced by use of computers represented by CGs and CADs can be utilized as image information.

The heat developable color light-sensitive material and/or the dye fixing element may have conductive exothermic layers as heating means for heat development or diffusion transfer of dyes. In this case, exothermic elements described in JP-A-61-145544 can be utilized.

Although the heating temperature in the heat development stage is about 50° C. to about 250° C., it is particularly useful to conduct heat development at a heating temperature of about 80° C. to about 180° C. Diffusion transfer of dyes may be carried out either concurrently with heat development or after termination of heat development. In the case of the latter, the transfer can be achieved at a heating temperature ranging from room temperature to the temperature in the heat development stage, more preferably at a temperature ranging from 50° C. to a temperature about 10° C. lower than the temperature in the heat development stage.

The movement of dyes takes place even only by heat. However, solvents may be used for accelerating the movement of dyes. As described in U.S. Pat. Nos. 4,704,345 and 4,740,445 and JP-A-61-238056, it is also useful to carry out heating in the presence of a small amount of solvent (particularly, water) to conduct development and transfer at the same time or continuously. In this system, the heating temperature is preferably 50° C. to the boiling point of the solvent. For example, when the solvent is water, the heating temperature is desirably 50° C. to 100° C.

Examples of the solvents used for acceleration of development and/or diffusion transfer of dyes include water, basic aqueous solutions containing inorganic alkali metal salts or organic bases (the bases described for the image formation accelerating agents are used as these bases), low boiling solvents, and mixed solutions of low boiling solvents and water or the above-mentioned basic aqueous solutions. Furthermore, surfactants, antifoggants, complex-formable compounds with slightly soluble metal salts, antifungal agents and microbiocides may be contained in the solvents.

Water is preferably used as the solvent used in the heat development stage and the diffusion transfer stage. Any water may be used as long as it is generally used. Specifically, distilled water, tap water, well water or mineral water can be used. In heat developing equipment in which the heat developable light-sensitive materials and the dye fixing elements are processed, water may be used in the disposable form, or repeatedly circulated. The latter case results in use of water containing components eluted from the light-sensitive materials. Further, equipment and water described in JP-A-63-144354, JP-A-63-144355, JP-A-62-38460 and JP-A-3-210555 may be used.

These solvents can be provided to either or both the heat developable color light-sensitive material and the dye fixing element. The use amount thereof may be the weight of solvent corresponding to the maximum swelled volume of the whole coated films or less.

For example, methods described in JP-A-62-253159, page 5, and JP-A-63-85544 are preferably used for applying the water. Further, solvents enclosed in microcapsules or hydrated can also be previously contained in either or both the heat developable light-sensitive material and the dye fixing element.

The temperature of water to be applied may be 30° C. to 60° C. as described in JP-A-63-85544. In particular, in order to prevent bacteria in water from propagating, it is useful to keep the temperature of water at 45° C. or more.

In order to accelerate the movement of dyes, hydrophilic heat solvents which are solid at ordinary temperature and soluble at high temperatures can also be contained in the heat developable light-sensitive material and/or the dye fixing element. The hydrophilic heat solvents may be contained in any of the light-sensitive silver halide emulsion layer, the intermediate layer, the protective layer and the dye fixing layer. However, it is preferred to be contained in the dye fixing layer and/or their adjacent layers.

Examples of the hydrophilic heat solvents include urea derivatives, pyridine derivatives, amides, sulfonamides, imides, alcohols, oximes and other heterocyclic compounds.

Heating methods in the development and/or transfer stage include methods of bringing the light-sensitive material and the dye fixing element into contact with heated blocks, heated plates, hot pressers, heat rolls, heat drums, halogen lamp heaters, infrared or far infrared lamp heaters, and methods of passing them through atmospheres of high temperatures.

As methods for superposing the heat developable light-sensitive material on the dye fixing element, methods described in JP-A-61-147244, page 27 can be applied.

Any of various heat development devices can be used for processing the photographic elements. For example, devices described in JP-A-59-75247, JP-A-59-177547, JP-A-59-181353, JP-A-60-18951, JP-A-U-62-25994 (the term "JP-A-U" as used herein means an "unexamined published Japanese utility model application"), and JP-A-6-130509, JP-A-6-95338 and JP-A-6-95267 are preferably used. As commercially available devices, Pictrostat 100, Pictrostat 200, Pictrography 3000 and Pictrography 2000 manufactured by Fuji Photo Film Co., Ltd. are preferably used.

When the above-mentioned images obtained by the heat developable color light-sensitive material and the dye fixing element are used as color proofs for printing, their density may be expressed by any of continuous gradation control, area gradation control utilizing discontinuities of density and combined gradation control of both.

Use of LDs or LEDs as the exposure light source permits the output of digital signals. This makes it possible to perform a process comprising controlling images on a CRT for the design and coloration of printed matter and outputting color proofs as the final output (DDCP). That is, the DDCP becomes an effective means for efficiently outputting proofs in the field of the color proofs. This is because a color printer is relatively simply constructed and inexpensive, and necessitates no formation of a platemaking film and a printing plate (PS plate), permitting easy formation of a plurality of hard copies having images formed on sheets for a short period of time, as well known.

When LDs or LEDs are used as the exposure light source, it is preferred that three spectral sensitivities of yellow, magenta and cyan, four spectral sensitivities of yellow, magenta, cyan and black, or spectral sensitivities of respective colors obtained by mixing two or more kinds of coloring materials have peaks of spectral sensitivities at different wavelengths 20 nm or more apart from each other. Further, there is another method of obtaining an image having tow or more kinds of colors by one exposure wavelength, when two or more different spectral sensitivities have a sensitivity difference of 10 times or more.

Subsequently, a method for reproducing moire on printed matter with a color printer.

For preparing printing color proofs for faithfully reproducing moire on high-resolution printed matter with a low-resolution color printer, each is converted to bit map data b'j of 48800 DPI, with reference to threshold value matrix 24 for each of halftone dot area rate data aj of CMYK, the fourth edition. Then, the area rate ci of each color is counted up, with reference to bit map data b'j within a definite range at the same time. Then, the first tristimulus value data X, Y and Z of 1600 DPI, i.e., calorimetric value data of the above-mentioned respective colors determined beforehand, are calculated. The anti-aliasing filter treatment was conducted to the first tristimulus value data X, Y and Z, and the second tristimulus value data X', Y' and Z' of 400 DPI are calculated. The resulting calculated data are used as input data for the color printer (the above is described in JP-A-8-192540 in detail).

When color images are recorded using an output device such as a color printer, it is possible to realize the color images having desired colors by operating color signals regarding, for example, yellow, magenta and cyan. However, the above-mentioned color signals depend on the output characteristics of the output device, so that color signals supplied from an external device different from the output device in characteristics are required to be processed by the color conversion treatment, taking into account the above-mentioned output characteristics.

There are methods which comprise preparing a plurality of known color patches different in color using the output device, measuring the color of the above-mentioned color patches, to thereby obtain, for example, a conversion relation by which known color signals CMY of the color patches are converted to stimulus value signals XYZ independent of the output device (this conversion relation is hereinafter referred to as a "regular conversion relation", then obtaining a conversion relation by which the stimulus value signals XYZ are converted to the color signals CMY utilizing the above-mentioned regular conversion relation (this conversion relation is hereinafter referred to as a "reverse conversion relation), and conducting the above-mentioned color conversion treatment using this reverse conversion relation.

The methods of determining the color signals CMY from the above-mentioned stimulus value signals XYZ include the following three examples, but examples of this invention are not limited thereto.

1. A method comprising establishing a tetrahedral whose vertexes are stimulus value signals XYZ of 4 points, dividing a space of the stimulus value signals XYZ with this tetrahedral, also similarly dividing a space of color signals CMY with a tetrahedral, and determining the color signals CMY to any stimulus value signals XYZ in the corresponding tetrahedral by a linear operation.

2. A method of determining color signals CMY corresponding to any stimulus value signals XYZ by repetitive operations using the Newton process (see *Photographic Science and Engineering*, vol. 16, No. 2, pp. 136–143, March–April (1972), "Metameric Color Matching in Subtractive Color Photography").

3. In a color conversion method for converting a color signal from the first color system to the second color system, the method comprising the first step of determining a relation of an real color signal of the above-mentioned first color system obtained from a known real color signal of the above-mentioned second color system, as a first regular conversion relation, the second step of approximating the above-mentioned first regular conversion relation with a monotone function to establish a virtual color signal outside a region comprising the above-mentioned real color signal, the third step of determining a relation of the color signal of the above-mentioned first color system obtained from a color signal composed of the above-mentioned real color signal and the above-mentioned virtual color signal in the above-mentioned second color system, as a second conversion relation, and the fourth step of determining a relation of a color signal of the above-mentioned first color system as a reverse conversion relation by use of repetitive operations. That is, in the color conversion method for converting the color signal from the first color system to the second color system, the real color signal (for example, XYZ signal) of the first color system corresponding to the known real color signal (for example, CMY signal) of the second color system is determined, and then, the first regular conversion relation between these real color signals is approximated with the monotone function to establish the virtual color signal outside the region composed of the above-mentioned real color signal. Then, the reverse conversion relation for converting the above-mentioned first color system to the above-mentioned second color system is obtained from the second regular conversion relation between the second color system comprising the above-mentioned real color signal and the above-mentioned virtual color signal, and the first color system, by the repetitive operations represented by the Newton process, and color conversion is performed by use of this reverse conversion relation.

The size of the above-mentioned images obtained from the heat developable color light-sensitive material and the dye fixing element may be any of the standard size of series A, A1 to A6, the kiku size, the standard size of series B, B1 to B6 and the small octavo size. Corresponding to the size, the width of the heat developable light-sensitive material and the dye fixing element can be within the range of 100 mm to 200 mm.

The heat developable light-sensitive material and the dye fixing element each may be supplied either in the roll form or in the sheet form. It is also possible to supply one in the roll form and the other in the sheet form.

The present invention will be further illustrated in greater detail below with reference to the following Examples, but the invention should not be construed as being limited thereto.

EXAMPLE

Dye fixing element M101 having the constitution shown in Table 1 was prepared.

Anionic Surfactant (1)

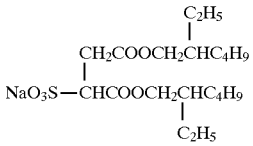

Anionic Surfactant (2)

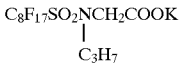

Anionic Surfactant (3)

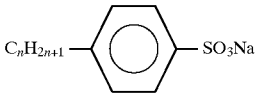

n ≈ 12.6

Anionic Surfactant (4)

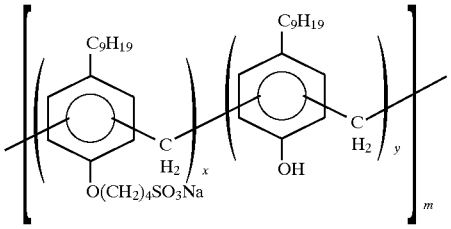

x:y = 4:6 m ≈ 6.8

Nonionic Surfactant (1)

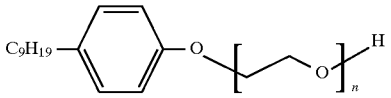

n = 85

-continued

Amphoteric Surfactant (1)

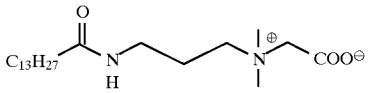

Fluorescent Brightener (1)

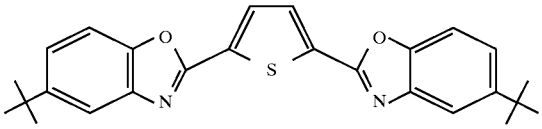

Mordant (1)

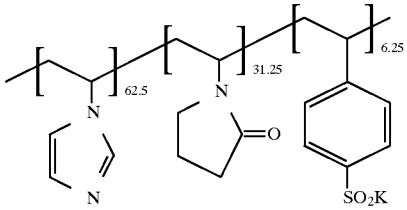

Stain Inhibitor (1)

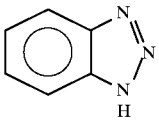

Stain Inhibitor (2)

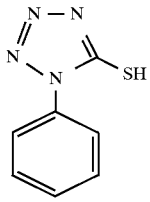

Stain Inhibitor (3)

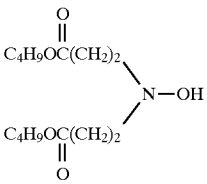

High Boiling Organic Solvent (1)

$C_8H_{46.9}Cl_{7.1}$
(Paraffin chloride 40 manufactured by Ajinomoto Co. Ltd.)

Water-Soluble Polymer (1)

Sumikaget L5-H
(manufactured by Sumitomo Chemical Co, Ltd.)

Water-Soluble Polymer (2)

Dextran (molecular weight: 70,000)

-continued

Water-Soluble Polymer (3)

Copper Carageenan (manufactured by Taito Co., Ltd.)

Water-Soluble Polymer (4)

MP Polymer MP-102 (manufactured by Kurarey Co., Ltd.)

Water-Soluble Polymer (5)

Acrylic-Modified Copolymer of Polyvinyl Alcohol (modification degree: 17%)

Latex Dispersion (1)

LX-438 (manufactured by Nippon Zeon Co., Ltd.)

Matte Agent (1)

SYLOID 79 (manufactured by Fuji Devison Kagaku Co., Ltd.)

Matte Agent (2)

PMMA Grains (means grain size: 4 μm)

Hardener (1)

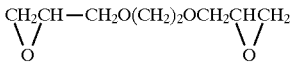

TABLE 1

Constitution of Dye Fixing Element M101

| Layer Number | Additive | Amount Coated ($mg/m^2$) |
|---|---|---|
| 6th Layer | Water-Soluble Polymer (1) | 130 |
| | Water-Soluble Polymer (2) | 35 |
| | Water-Soluble Polymer (3) | 45 |
| | Potassium Nitrate | 20 |
| | Anionic Surfactant (1) | 6 |
| | Anionic Surfactant (2) | 6 |
| | Amphoteric Surfactant (1) | 50 |
| | Stain Inhibitor (1) | 7 |
| | Stain Inhibitor (2) | 12 |
| | Matte Agent (1) | 7 |
| 5th Layer | Acid-Treated Gelatin | 170 |
| | Water-Soluble Polymer (5) | 35 |
| | Anionic Surfactant (3) | 6 |
| | Matte Agent (1) | 140 |
| | Hardener (1) | 60 |
| 4th Layer | Mordant (1) | 1850 |
| | Water-Soluble Polymer (2) | 260 |
| | Water-Soluble Polymer (4) | 1400 |
| | Latex Dispersion (1) | 600 |
| | Anionic Surfactant (3) | 25 |
| | Nonionic Surfactant (1) | 18 |
| | Guanidine Picolinate | 2550 |
| | Sodium Quinolinate | 350 |
| 3rd Layer | Gelatin | 370 |
| | Mordant (1) | 300 |
| | Anionic Surfactant (3) | 12 |
| 2nd Layer | Gelatin | 700 |
| | Mordant (1) | 290 |
| | Water-Soluble Polymer (1) | 55 |
| | Water-Soluble Polymer (2) | 330 |
| | Anionic Surfactant (3) | 30 |
| | Anionic Surfactant (4) | 7 |
| | High Boiling Solvent (1) | 700 |
| | Fluorescent Brightener (1) | 30 |
| | Stain Inhibitor (3) | 32 |
| | Guanidine Picolinate | 360 |
| | Potassium Quinolinate | 45 |
| 1st Layer | Acid-Treated Gelatin | 290 |
| | Anionic Surfactant (1) | 16 |

TABLE 1-continued

Constitution of Dye Fixing Element M101

| Layer Number | Additive | Amount Coated ($mg/m^2$) |
|---|---|---|
| | Sodium Metaborate | 45 |
| | Matte Agent (2) | 490 |
| | Hardener (1) | 310 |

Support (1): Paper Support Laminated with Polyethylene (thickness: 215 μm)

TABLE 2

Support (1)

| Layer Name | Composition | Layer Thickness (μm) |
|---|---|---|
| Surface Undercoat Layer | Gelatin | 0.1 |
| Surface PE Layer | Low-Density Polyethylene (density: 0.923): 90.2 parts Surface-Treated Titanium Oxide: 9.8 parts | 36.0 |
| Pulp Layer | Woodfree Paper (LBKP/NBKP = 1/1, density: 1.080) | 152.0 |
| Back PE Layer | High-Density Polyethylene (density: 0.955) | 27.0 |
| Back Undercoat Layer | Styrene/Acrylate Copolymer Colloidal Silica Polysodium Styrenesulfonate | 0.1 |
| | | 215.2 |

Further, dye fixing element M102 was prepared by omitting fluorescent brightener (1) in the second layer of M101.

Then, a method for preparing a heat developable color light-sensitive material is described.

First, methods for preparing light-sensitive silver halide emulsions are described.

Preparation of Light-Sensitive Silver Halide Emulsion (1)

(Emulsion for Fifth Layer (680 nm Light-Sensitive Layer))

Solution (I) and solution (II) having the compositions shown in Table 4 were concurrently added to an aqueous solution having the composition shown in Table 3 over a period of 13 minutes with sufficient stirring. Ten minutes after that, solution (III) and solution (IV) having the compositions shown in Table 4 were added over a period of 33 minutes.

TABLE 3

(Composition)

| | |
|---|---|
| $H_2O$ | 620 ml |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 45° C. |

TABLE 4

| | Solution I | Solution II | Solution III | Solution IV |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_6$ | — | — | — | 0.039 mg |
| Total Amount | Water to make 126 ml | Water to make 132 ml | Water to make 254 ml | Water to make 252 ml |

Solvent for Silver Halide (1)

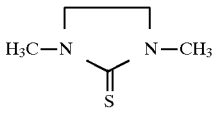

Further, 150 cc of a 0.35% aqueous solution of sensitizing dye (1) was added thereto over a period of 27 minutes starting at the time of 13 minutes after the start of addition of solution (III).

After conventional washing and salt removal (conducted at pH 4.1 using precipitant a), 22 g of lime-treated ossein gelatin was added. After adjusting the pH to 6.0 and the pAg to 7.9, chemical sensitization was conducted at 60° C. Compounds used in the chemical sensitization are as shown in Table 5. Thus, a monodisperse cubic silver chlorobromide emulsion having a coefficient of variation of 10.2% and a mean grain size of 0.20 $\mu$m was obtained. The yield of this emulsion was 630 g.

Sensitizing Dye (1)

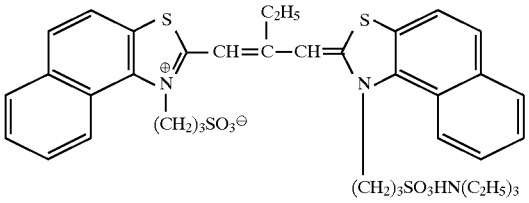

TABLE 5

| Agent Used in Chemical Sensitization | Amount Added |
|---|---|
| 4-Hydroxy-6-methyl-1,3,3a,7-tetraazaindene | 0.36 g |
| Sodium Thiosulfate | 6.75 mg |
| Antifoggant (1) | 0.11 g |
| Preservative (1) | 0.07 g |
| Preservative (2) | 3.13 g |

Precipitant a

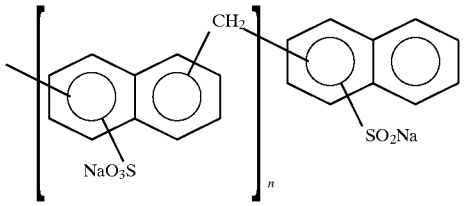

-continued

Precipitant b

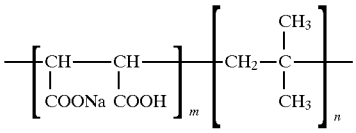

Antifoggant (1)

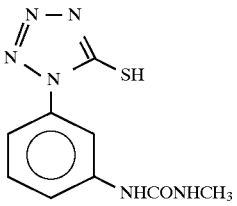

Preservative (1)

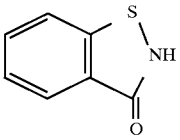

Preservative (2)

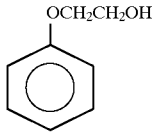

Preparation of Light-Sensitive Silver Halide Emulsion (2)

(Emulsion for Third Layer (750 nm Light-Sensitive Layer))

Solution (I) and solution (II) having the compositions shown in Table 7 were concurrently added to an aqueous solution having the composition shown in Table 6 over a period of 18 minutes with sufficient stirring. Ten minutes after that, solution (III) and solution (IV) having the compositions shown in Table 7 were added over a period of 24 minutes.

TABLE 6

| (Composition) | |
|---|---|
| $H_2O$ | 620 cc |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 45° C. |

TABLE 7

| | Solution I | Solution II | Solution III | Solution IV |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | — | — | — | 0.07 g |
| $K_2IrCl_6$ | — | — | — | 0.040 mg |
| Total | Water to | Water to | Water to | Water to |

TABLE 7-continued

| | Solution I | Solution II | Solution III | Solution IV |
|---|---|---|---|---|
| Amount | make 188 ml | make 188 ml | make 250 ml | make 250 ml |

After conventional washing and salt removal (conducted at pH 3.9 using precipitant b), 22 g of lime-treated ossein gelatin subjected to the calcium removal treatment (calcium content: 150 ppm or less) was added and dispersed again at 40° C. Then, 0.39 g of 4-hydroxy-6-methyl-1,3,3a,7-tetraazaindene was added to adjust the pH to 5.9 and the pAg to 7.8, followed by chemical sensitization at 70° C. using the agents shown in Table 8. At the end of the chemical sensitization, a solution of sensitizing dye (2) in methanol (a solution having the composition shown in Table 9) was added. After the chemical sensitization, the temperature was lowered to 40° C., and 200 g of a dispersion of stabilizer (1) in gelatin describer below was added. After sufficient stirring, the resulting product was stored. Thus, a monodisperse cubic silver chlorobromide emulsion having a coefficient of variation of 12.6% and a mean grain size of 0.25 $\mu$m was obtained. The yield of this emulsion was 938 g.

TABLE 8

| Agent Used in Chemical Sensitization | Amount Added |
|---|---|
| 4-Hydroxy-6-methyl-1,3,3a,7-tetraazaindene | 0.39 g |
| Triethylthiourea | 3.3 mg |
| Degradation Product of Nucleic Acid | 0.39 g |
| NaCl | 0.15 g |
| KI | 0.12 g |
| Antifoggant (2) | 0.10 g |
| Preservative (1) | 0.07 g |

TABLE 9

| Composition of Dye Solution | Amount Added |
|---|---|
| Sensitizing Dye (2) | 0.19 g |
| Methanol | 18.7 cc |

Stabilizer (1)

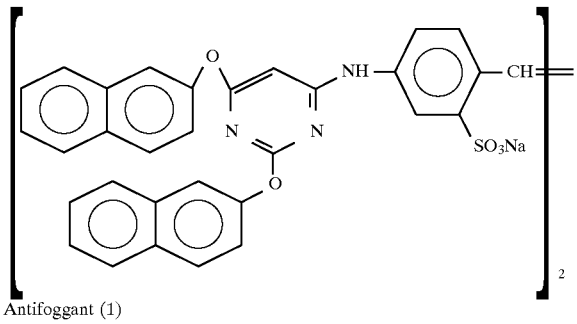

Antifoggant (1)

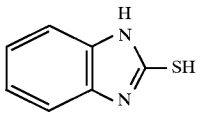

-continued

Sensitizing Dye (2)

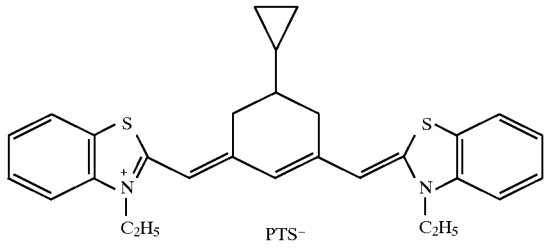

PTS: p-Toluenesulfonic Acid

Preparation of Light-Sensitive Silver Halide Emulsion (3)

(Emulsion for First Layer (810 nm Light-Sensitive Layer))

Solution (I) and solution (II) having the compositions shown in Table 11 were concurrently added to an aqueous solution having the composition shown in Table 10 over a period of 18 minutes with sufficient stirring. Ten minutes after that, solution (III) and solution (IV) having the compositions shown in Table 11 were added over a period of 24 minutes.

TABLE 10

| (Composition) | |
|---|---|
| $H_2O$ | 620 cc |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 50° C. |

TABLE 11

| | Solution I | Solution II | Solution III | Solution IV |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total Amount | Water to make 180 ml | Water to make 181 ml | Water to make 242 ml | Water to make 250 ml |

After conventional washing and salt removal (conducted at pH 3.8 using precipitant a), 22 g of lime-treated ossein gelatin was added to adjust the pH to 7.4 and the pAg to 7.8, followed by chemical sensitization at 60° C. Compounds used in the chemical sensitization are as shown in Table 12. Thus, a monodisperse cubic silver chlorobromide emulsion having a coefficient of variation of 9.7% and a mean grain size of 0.32 $\mu$m was obtained. The yield of this emulsion was 683 g.

TABLE 12

| Agent Used in Chemical Sensitization | Amount Added |
|---|---|
| 4-Hydroxy-6-methyl-1,3,3a,7-tetraazaindene | 0.38 g |
| Triethylthiourea | 3.10 mg |
| Antifoggant (2) | 0.19 g |
| Preservative (1) | 0.07 g |
| Preservative (2) | 3.13 g |

Preparation of Dispersion of Colloidal Silver in Gelatin

A solution having the composition shown in Table 14 was added to an aqueous solution having the composition shown in Table 13 with sufficient stirring. Then, after washing with precipitant a, 43 g of lime-treated ossein gelatin was added to adjust the pH to 6.3. Thus, a dispersion containing 2% silver and 6.8% gelatin was obtained. The mean grain size thereof was 0.02 μm and the yield thereof was 512 g.

TABLE 13

| (Composition) | |
|---|---|
| $H_2O$ | 620 cc |
| Dextrin | 16 g |
| NaOH (5 N) | 41 cc |
| Temperature | 30° C. |

TABLE 14

| (Composition) | |
|---|---|
| $H_2O$ | 135 cc |
| $AgNO_3$ | 17 g |

Preparation of Dispersions of Hydrophobic Additives in Gelatin

Dispersions of a yellow dye-donating compound, a magenta dye-donating compound and cyan dye-donating compounds in gelatin were each prepared according to the formulation shown in Table 15. That is, for each dispersion, the respective oily phase components were melted by heating at about 70° C. to form a homogeneous solution. To this solution were added the aqueous phase components heated to about 60° C., and mixed by stirring, followed by dispersing at 10000 rpm with a homogenizer for 10 minutes. Water was added thereto and stirred to obtain a homogeneous dispersion. Further, for the dispersion of cyan dye-donating compounds in gelatin, dilution with water and concentration were repeated by use of an ultrafiltration module (ACV-3050, manufactured by Asahi Chemical Industries Co., Ltd.) to decrease the amount of ethyl acetate so as to give 1/17.6 the amount of ethyl acetate shown in Table 15.

TABLE 15

| | Composition of Dispersion | | |
|---|---|---|---|
| | Yellow Dispersion | Magenta Dispersion | Cyan Dispersion |
| Oily Phase | | | |
| Cyan Dye-Donating Compound (1) | — | — | 17.7 g |
| Cyan Dye-Donating Compound (2) | — | — | 3.6 g |
| Magenta Dye-Donating Compound (1) | — | 18.5 g | — |
| Yellow Dye-Donating Compound (1) | 9.8 g | — | — |
| Reducing Agent (1) | 0.9 g | 0.2 g | 1.0 g |
| Antifoggant (3) | 0.1 g | — | 0.2 g |
| Antifoggant (4) | — | 0.7 g | — |
| Surfactant (1) | 1.1 g | — | — |
| High Boiling Solvent (1) | 6.2 g | — | — |
| High Boiling Solvent (2) | — | 7.4 g | 13.3 g |
| Development Accelerator (1) | 2.5 g | 2.9 g | — |
| Development Accelerator (2) | — | — | 7.1 g |
| Dye (a) | 1.1 g | — | 0.5 g |

TABLE 15-continued

| | Composition of Dispersion | | |
|---|---|---|---|
| | Yellow Dispersion | Magenta Dispersion | Cyan Dispersion |
| Water | 0.4 ml | — | — |
| Ethyl Acetate | 9.6 ml | 50.1 ml | 55.2 ml |
| Aqueous Phase | | | |
| Lime-Treated Gelatin | 10.0 g | 10.0 g | 10.0 g |
| Calcium Nitrate | 0.1 g | 0.1 g | 0.1 g |
| Surfactant (1) | — | 0.2 g | 0.8 g |
| Aqueous Solution of Sodium Hydroxide (1 N) | — | 1.9 ml | — |
| Carboxymethyl Cellulose | — | — | 0.3 g |
| Water | 26.1 ml | 139.7 ml | 95.9 ml |
| Water Added after Emulsification | 99.9 ml | 157.3 ml | 209.0 ml |
| Preservative (1) | 0.004 g | 0.04 g | 0.1 g |

Preparation of Dispersion of Antifoggant (4) in Gelatin

A dispersion of antifoggant (4) in gelatin was prepared according to the formulation shown in Table 16. That is, the oily phase components were melted by heating at about 60° C., and the aqueous phase components heated to about 60° C. were added to the resulting solution and mixed by stirring, followed by dispersing at 10000 rpm with a homogenizer for 10 minutes to obtain a homogeneous dispersion.

TABLE 16

| | Composition of Dispersion |
|---|---|
| Oily Phase | |
| Antifoggant (4) | 0.8 g |
| Reducing Agent (1) | 0.1 g |
| High Boiling Solvent (2) | 2.3 g |
| High Boiling Solvent (5) | 0.2 g |
| Surfactant (1) | 0.5 g |
| Surfactant (4) | 0.5 g |
| Ethyl Acetate | 10.0 ml |
| Aqueous Phase | |
| Acid-Treated Gelatin | 10.0 g |
| Preservative (1) | 0.004 g |
| Calcium Nitrate | 0.1 g |
| Water | 35.0 g |
| Water Added | 104.0 ml |

Preparation of Dispersion of High Boiling Solvent (2) in Gelatin

A dispersion of high boiling solvent (2) in gelatin was prepared according to the formulation shown in Table 17. That is, the oily phase components were melted by heating at about 60° C., and the aqueous phase components heated to about 60° C. were added to the resulting solution and mixed by stirring, followed by dispersing at 10000 rpm with a homogenizer for 10 minutes to obtain a homogeneous dispersion.

TABLE 17

| | Composition of Dispersion |
|---|---|
| Oily Phase | |
| High Boiling Solvent (2) | 2.3 g |
| High Boiling Solvent (5) | 0.2 g |
| Surfactant (1) | 0.5 g |
| Surfactant (4) | 0.5 g |
| Ethyl Acetate | 10.0 ml |

TABLE 17-continued

| | Composition of Dispersion |
|---|---|
| Aqueous Phase | |
| Acid-Treated Gelatin | 10.0 g |
| Preservative (1) | 0.004 g |
| Calcium Nitrate | 0.1 g |
| Water | 35.0 g |
| Water Added | 104.0 ml |

Preparation of Dispersion of Reducing Agent (2) in Gelatin

A dispersion of reducing agent (2) in gelatin was prepared according to the formulation shown in Table 18. That is, the oily phase components were melted by heating at about 60° C., and the aqueous phase components heated to about 60° C. were added to the resulting solution and mixed by stirring, followed by dispersing at 10000 rpm with a homogenizer for 10 minutes to obtain a homogeneous dispersion. Further, ethyl acetate was removed from the resulting dispersion with a vacuum organic solvent-removing apparatus.

TABLE 18

| | Composition of Dispersion |
|---|---|
| Oily Phase | |
| Reducing Agent (2) | 7.5 g |
| High Boiling Solvent (1) | 4.7 g |
| Surfactant (1) | 1.9 g |
| Ethyl Acetate | 14.4 ml |
| Aqueous Phase | |
| Acid-Treated Gelatin | 10.0 g |
| Preservative (1) | 0.02 g |
| Preservative (3) | 0.04 g |
| Sodium Hydrogensulfite | 0.1 g |
| Water | 136.7 ml |

Preparation of Dispersions of Polymer Latex (a) in Gelatin

A dispersion of polymer latex (a) in gelatin was prepared according to the formulation shown in Table 19. That is, anionic surfactant (6) was added to a mixed solution of polymer latex (a), surfactant (5) and water over a period of 10 minutes with stirring to obtain a homogeneous solution. Further, for the resulting dispersion, dilution with water and concentration were repeated by use of an ultrafiltration module (ACV-3050, manufactured by Asahi Chemical Industries Co., Ltd.) to decrease the concentration of the salt in the dispersion to 1/9.

TABLE 19

| | Composition of Dispersion |
|---|---|
| Aqueous Solution of Polymer Latex (a) (solid content: 13%) | 108.0 ml |
| Surfactant (5) | 20.0 g |
| Aqueous Solution of Anionic | 600 ml |

TABLE 19-continued

| | Composition of Dispersion |
|---|---|
| Surfactant (6) (5%) | |
| Water | 1232.0 ml |

Preparation of Dispersion of Stabilizer (1) in Gelatin

A dispersion of stabilizer (1) in gelatin was prepared according to the formulation shown in Table 20. That is, the oily phase components were melted at room temperature, and the aqueous phase components heated to about 40° C. were added to the resulting solution and mixed by stirring, followed by dispersing at 10000 rpm with a homogenizer for 10 minutes. Water was added thereto and stirred to obtain a homogeneous dispersion.

TABLE 20

| | Composition of Dispersion |
|---|---|
| Oily Phase | |
| Stabilizer (1) | 4.0 g |
| Sodium Hydroxide | 0.3 g |
| Methanol | 62.8 g |
| High Boiling Solvent (4) | 0.9 g |
| Aqueous Phase | |
| Gelatin Subjected to Calcium Removal Treatment (Ca content: 100 ppm or less) | 10.0 g |
| Preservative (1) | 0.04 g |
| Water | 320.5 ml |

Preparation of Dispersion of Zinc Hydroxide in Gelatin

A dispersion of zinc hydroxide in gelatin was prepared according to the formulation shown in Table 21. That is, the respective components were mixed and dissolved, followed by dispersing in a mill using glass beads having a mean grain size of 0.75 mm for 30 minutes. Further, the glass beads were removed by separation to obtain a homogeneous dispersion. Zinc hydroxide having a mean grain size of 0.25 $\mu$m was used.

TABLE 21

| | Composition of Dispersion |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| High Boiling Solvent (4) | 0.4 g |

Preparation of Dispersion of Matte Agent in Gelatin to Be Added to Protective Layer A solution of PMMA in methylene chloride was added to gelatin together with a small amount of surfactant, and dispersed by stirring at high speed. Subsequently, methylene chloride was removed with a vacuum solvent-removing apparatus to obtain a homogeneous dispersion having a mean grain size of 4.3 $\mu$m.

Cyan Dye-Donating Compound (1)
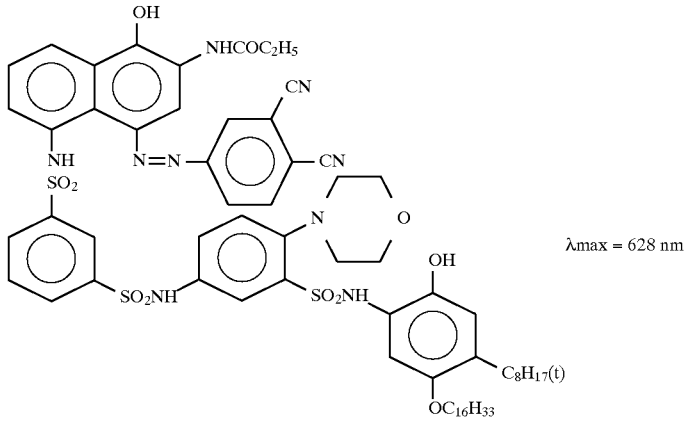
Cyan Dye-Donating Compound (2)
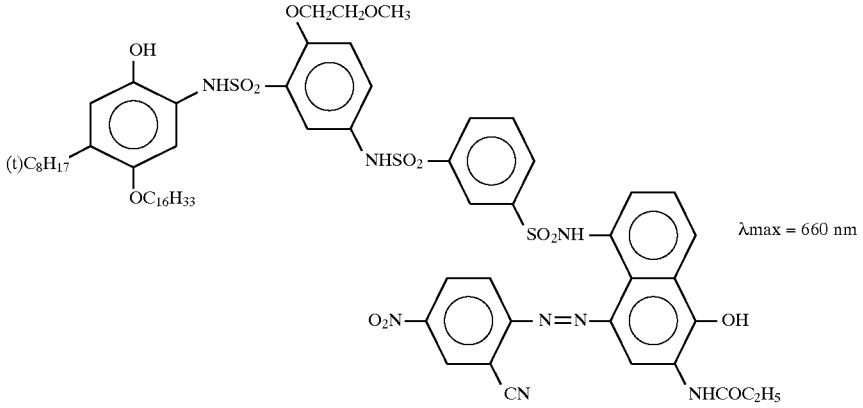
Dye (a)
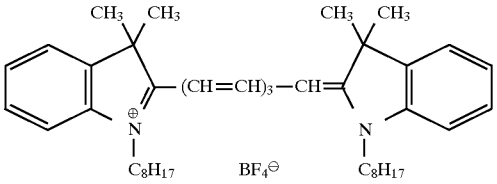
Magenta Dye-Donating Compound (1)
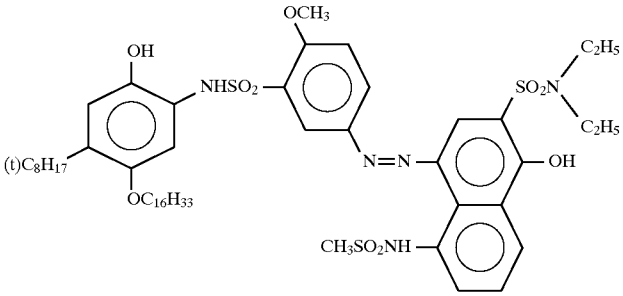

-continued
Yellow Dye-Donating Compound (1)
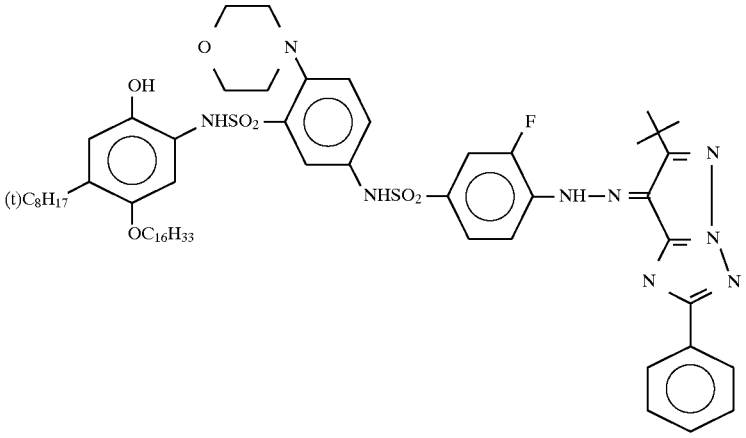
Reducing Agent (1)
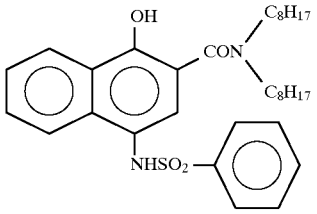
Antifoggant (3)
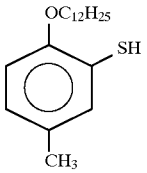
Antifoggant (4)
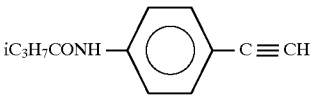
Surfactant (1)
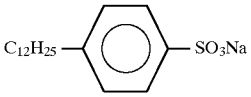
Development Accelerator (1)
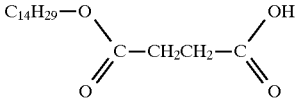
Development Accelerator (2)
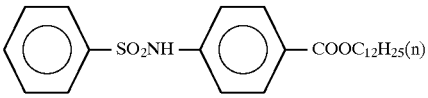
High Boiling Solvent (1)
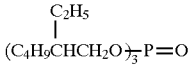
High Boiling Solvent (2)
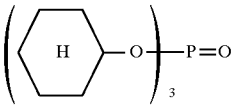

-continued
Preservative (3)
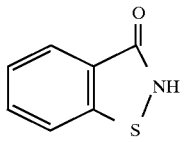
Reducing Agent (2)
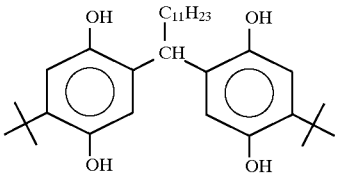
Preservative (4)
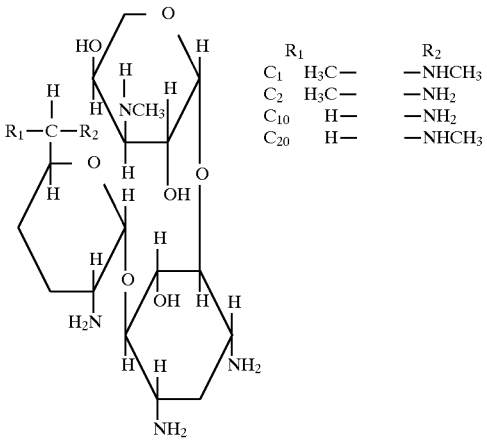
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant (2)
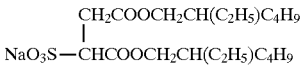
Surfactant (3)
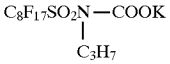
Water-Soluble Polymer (1)
Limiting viscosity number [η]: 1.6
Molecular weight: ca. 1,000,000
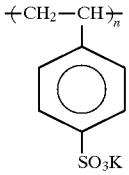
Water-Soluble Polymer (2)
Limititing viscosity number [η]: 0.8
Molecular weight: ca. 400,000
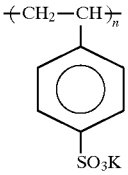

-continued
Sensitizing Dye (3)
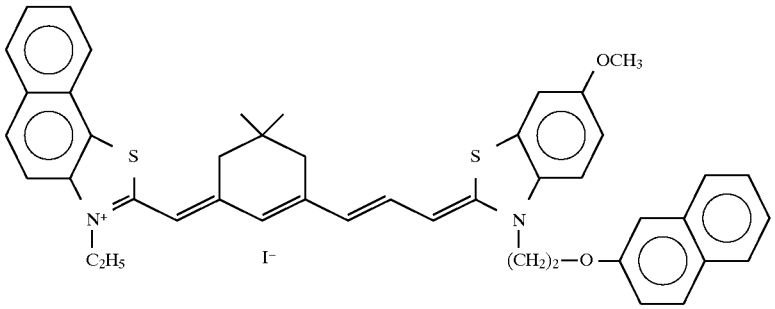
Hardener (1)
$$CH_2{=}CHSO_2CH_2SO_2CH{=}CH_2$$
Surfactant (4)
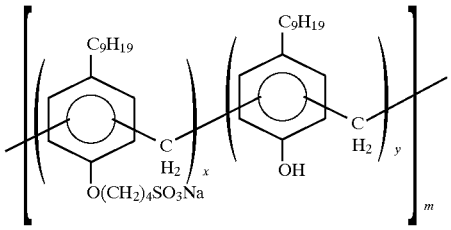
x:y = 4:6 m ≈ 6.8
High Boiling Organic Solvent (5)
$$C_{28}H_{46.9}Cl_{7.1}$$
(Paraffin chloride 40, manufactured by Ajinomoto Co. Ltd.)
Polymer Latex (a)
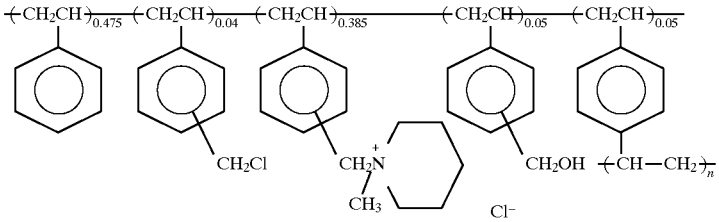
Surfactant (5)
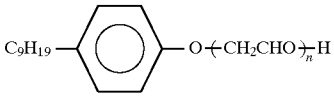
n = 50
Anionic Surfactant (6)
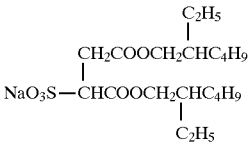
heat developable light-sensitive material 100 shown in table 22 was prepared using the above-mentioned compounds.

TABLE 22

Constitution of Main Raw Materials of Heat Developable Light-Sensitive Material 100

| Layer No. | Layer Name | Additive | Amount Coated ($mg/m^2$) |
|---|---|---|---|
| 7th Layer | Protective Layer | Acid-Treated Gelatin | 442 |
| | | Reducing Agent (2) | 47 |
| | | High Boiling Solvent (1) | 30 |
| | | Colloidal Silver Grains | 2 |
| | | Matte Agent (PMMA Resin) | 17 |
| | | Surfactant (2) | 16 |
| | | Surfactant (1) | 9 |
| | | Surfactant (3) | 2 |
| 6th Layer | Intermediate Layer | Lime-Treated Gelatin | 862 |
| | | Antifoggant (4) | 33 |
| | | Reducing Agent (1) | 4 |
| | | High Boiling Solvent (2) | 98 |
| | | High Boiling Solvent (5) | 10 |
| | | Surfactant (1) | 21 |
| | | Surfactant (4) | 20 |
| | | Water-Soluble Polymer (1) | 4 |
| | | Calcium Nitrate | 21 |
| 5th Layer | Red-Sensitive Layer | Lime-Treated Gelatin | 452 |
| | | Light-Sensitive Silver Halide Emulsion (1) | 301 (in terms of silver) |
| | | Magenta Dye-Donating Compound (1) | 451 |
| | | High Boiling Solvent (2) | 221 |
| | | Reducing Agent (1) | 6 |
| | | Development Accelerator (1) | 71 |
| | | Antifoggant (4) | 20 |
| | | Surfactant (1) | 0.3 |
| | | Water-Soluble Polymer (1) | 11 |
| 4th Layer | Intermediate Layer | Lime-Treated Gelatin | 485 |
| | | Antifoggant (4) | 33 |
| | | Reducing Agent (1) | 4 |
| | | High Boiling Solvent (2) | 98 |
| | | High Boiling Solvent (5) | 10 |
| | | Surfactant (1) | 21 |
| | | Surfactant (4) | 20 |
| | | Dispersion of Polymer Latex (a) | 1 |
| | | Water-Soluble Polymer (1) | 2 |
| | | Calcium Nitrate | 8 |
| 3rd Layer | Second Infrared-Sensitive Layer | Lime-Treated Gelatin | 373 |
| | | Light-Sensitive Silver Halide Emulsion (2) | 106 (in terms of silver) |
| | | Stabilizer (1) | 9 |
| | | Cyan Dye-Donating Compound (2) | 78 |
| | | Cyan Dye-Donating Compound (1) | 383 |
| | | Dye (a) | 10 |
| | | High Boiling Solvent (1) | 101 |
| | | High Boiling Solvent (2) | 108 |

TABLE 22-continued

Constitution of Main Raw Materials of Heat Developable Light-Sensitive Material 100

| Layer No. | Layer Name | Additive | Amount Coated ($mg/m^2$) |
|---|---|---|---|
| | | High Boiling Solvent (3) | 27 |
| | | Reducing Agent (1) | 22 |
| | | Antifoggant (3) | 4 |
| | | Surfactant (1) | 0.9 |
| | | Carboxymethyl Cellulose | 5 |
| | | Water-Soluble Polymer (1) | 11 |
| | | Development Accelerator (2) | 154 |
| 2nd Layer | Intermediate Layer | Lime-Treated Gelatin | 438 |
| | | High Boiling Solvent (2) | 98 |
| | | High Boiling Solvent (5) | 10 |
| | | Surfactant (1) | 21 |
| | | Surfactant (4) | 20 |
| | | Zinc Hydroxide | 750 |
| | | Water-Soluble Polymer (2) | 26 |
| | | Calcium Nitrate | 8 |
| 1st Layer | First Infrared-Sensitive Layer | Lime-Treated Gelatin | 587 |
| | | Light-Sensitive Silver Halide Emulsion (3) | 311 (in terms of silver) |
| | | Stabilizer (1) | 8 |
| | | Yellow Dye-Donating Compound (1) | 403 |
| | | Sensitizing Dye (4) | 0.1 |
| | | Dye (a) | 44 |
| | | High Boiling Solvent (2) | 201 |
| | | Reducing Agent (1) | 35 |
| | | Development Accelerator (1) | 101 |
| | | Antifoggant (3) | 6 |
| | | Surfactant (1) | 32 |
| | | Water-Soluble Polymer (2) | 46 |
| | | Hardener (1) | 45 |

Support: Paper Support Laminated with Polyethylene (thickness: 131 $\mu$m)
Note:
Trace additives such as preservatives are omitted to show.

The following heat developable color light-sensitive materials 101 to 105 were further prepared as materials of this invention.

Preparation of Light-Sensitive Material 101

Light-sensitive material 101 was prepared in the same manner as for light-sensitive material 100, except that the amount of cyan dye-donating compound (2) of the cyan dispersion added to the third layer of light-sensitive material 100 was changed to 5.4 g, and that cyan dye-donating compound (1) was changed to cyan dye-donating compound (3) having a structure shown below and the amount thereof added to the dispersion in Table 15 was changed to 12.8 g.

Cyan Dye-Donating Compound (3)

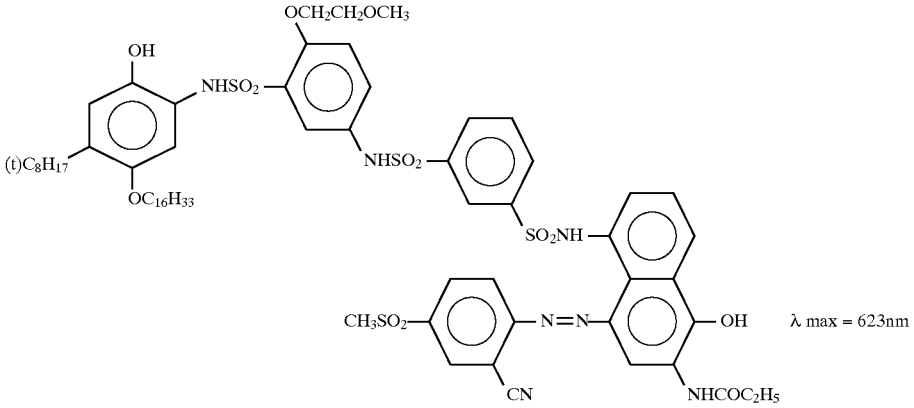

Preparation of Light-Sensitive Material 102

Light-sensitive material 102 was prepared in the same manner as for light-sensitive material 100, except that yellow dye-donating compound (1) of the yellow dispersion added to the first layer of light-sensitive material 100 was changed to yellow dye-donating compound (2) having a structure shown below, and the amount thereof added to the dispersion in Table 15 was changed to 9.0 g.

Yellow Dye-Donating Compound (2)

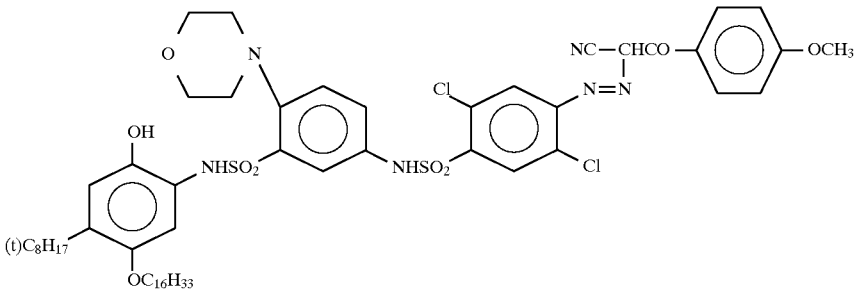

Preparation of Light-Sensitive Material 103

Light-sensitive material 103 was prepared in the same manner as for light-sensitive material 100, except that yellow dye-donating compound (1) of the yellow dispersion added to the first layer of light-sensitive material 100 was changed to yellow dye-donating compound (2), and the amount thereof added to the dispersion in Table 15 was changed to 9.0 g.

Preparation of Light-Sensitive Material 104

Light-sensitive material 104 was prepared in the same manner as for light-sensitive material 100, except that yellow dye-donating compound (1) of the yellow dispersion added to the first layer of light-sensitive material 100 was changed to yellow dye-donating compound (3) having a structure shown below, the amount thereof added to the dispersion shown in Table 15 was changed to 8.5 g, cyan dye-donating compound (1) of the cyan dispersion added to the third layer of light-sensitive material 100 was changed to cyan dye-donating compound (4) having a structure shown below, the amount thereof added to the dispersion in Table 15 was changed to 16.9 g, magenta dye-donating compound (1) of the magenta dispersion added to the fifth layer of light-sensitive material 100 was changed to magenta dye-donating compound (2), the amount thereof added to the dispersion in Table 15 was changed to 16.8 g, and 2.5 g of development accelerator (2) was added.

Yellow Dye-Donating Compound (3)

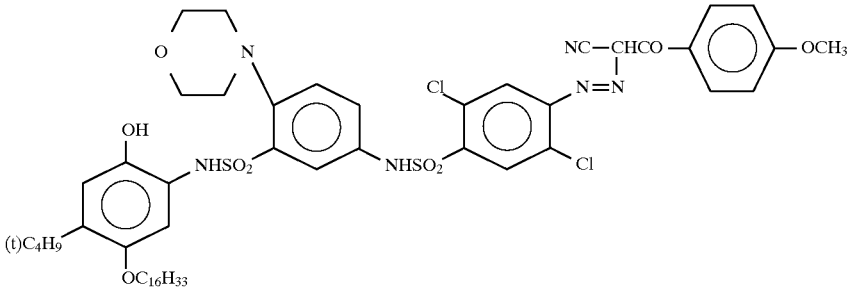

Cyan Dye-Donating Compound (4)

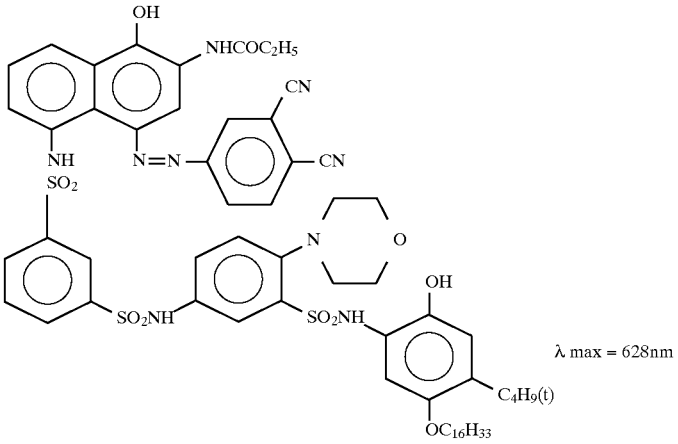

Magenta Dye-Donating Compound (2)

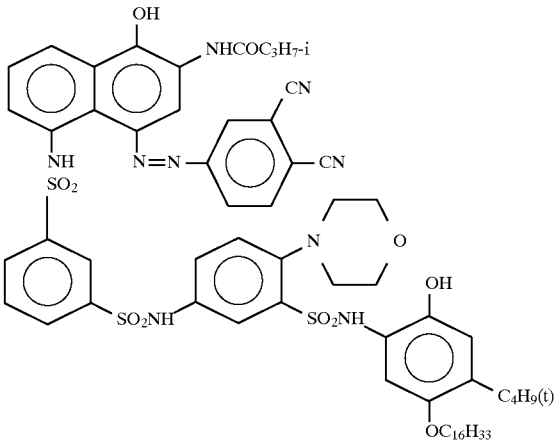

Preparation of Light-Sensitive Material 105

Light-sensitive material 105 was prepared in the same manner as for light-sensitive material 100, except that magenta dye-donating compound (1) of the magenta dispersion added to the fifth layer of light-sensitive material 100 was changed to magenta dye-donating compound (3) having a structure shown below, and the amount thereof added to the dispersion in Table 15 was changed to 18.8 g.

Magenta Dye-Donating Compound (3)

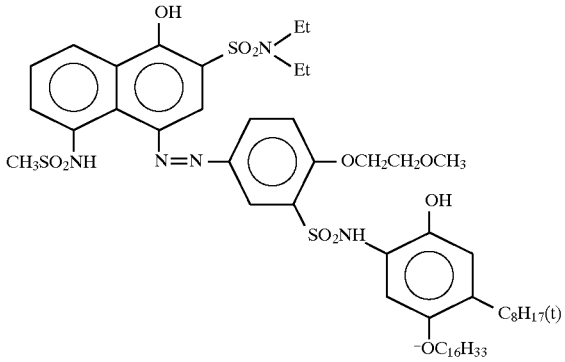

Then, the following heat developable color light-sensitive materials 106 and 107 were prepared as materials for comparison.

Preparation of Light-Sensitive Material 106

Light-sensitive material 106 was prepared in the same manner as for light-sensitive material 100, except that the amount of cyan dye-donating compound (2) of the cyan dispersion added to the third layer of light-sensitive material 100 was changed to 0 g.

Preparation of Light-Sensitive Material 107

Light-sensitive material 107 was prepared in the same manner as for light-sensitive material 100, except that cyan dye-donating compound (1) of the cyan dispersion added to the third layer of light-sensitive material 100 was changed to cyan dye-donating compound (5) having a structure shown below, and the amount thereof added to the dispersion in Table 15 was changed to 17.3 g.

Cyan Dye-Donating Compound (5)

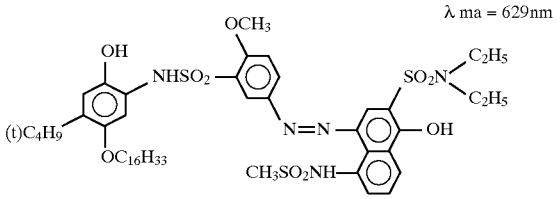

These light-sensitive materials 100 to 107 were each combined with dye fixing elements M101 and M102, and the image output was carried out with a Fujix Pictrography 3000 digital color printer manufactured by Fuji Photo Film Co., Ltd. under the standard conditions. The output images were a plurality of standard color charts for printing (calibration charts) of 250 to 2000 colors. Color matching was conducted by three methods of the color conversion methods described in this specification, using these color charts.

After color matching, the standard color charts for printing were output again. For each of the standard color charts for printing and the standard color charts output from the PG-3000 printer, the hue was measured, and the color reproduction region was calculated. From this result, a value at the time when the color difference on the chromaticity diagram of a region from cyan to green and a region from magenta to red indicated the maximum value at an L value of 60 is shown in Table 24. This color difference is a value in the case where the color reproduction region of the sample output from the PG-3000 printer by the above-mentioned method is narrower than the color reproduction region for printing. Further, the difference in color was visually judged for each patch of both the color charts. The case where no difference was observed was evaluated as o, and the case where the difference was observed was evaluated as x. Results thereof are summarized in Table 23.

Further, for the samples output from the PG-3000 printer, the maximum image density of black areas was measured. The measurement was made with an X-Rite 310TR filter (status A filter) manufactured by Nippon Heiban Kizai Co. Ltd. Of the measurements, the visual density is described in Table 23. Then, the light source dependency of output samples was examined. Three kinds of lighting light sources (observation light sources), a D65 light source, a tungsten CIEA light source and a fluorescent lamp F-6 light source which are standard light sources, were used in observation. A gray area of each sample illuminated with each light source was visually evaluated from a low density area to a high density area. Comparing with the standard printing color chart, a sample showing larger change in coloration of gray depending on the kind of light source was evaluated as x, a sample showing almost the same change in coloration was evaluated as Δ, and a sample showing less change was evaluated as o. Results thereof are summarized in Table 23.

TABLE 23

| No. | Image Receiving Material | Dye Fixing Element | Heat Developable Color Light-Sensitive Material | Dye-Donating Compound Y | Dye-Donating Compound M | Dye-Donating Compound Cy | Absorption Peak Wavelength of Dye (nm) Y | Absorption Peak Wavelength of Dye (nm) M | Absorption Peak Wavelength of Dye (nm) Cy | λc (10%−) (nm) | λc (10%+) (nm) |
|---|---|---|---|---|---|---|---|---|---|---|---|
| 1 | Invention | M101 | 100 | Y(1) | M(1) | C(1)C(2) | 451 | 537 | 630 | 536 | 695 |
| 2 | Invention | M101 | 101 | Y(1) | M(1) | C(2)C(3) | 451 | 537 | 625 | 536 | 712 |
| 3 | Invention | M101 | 102 | Y(2) | M(1) | C(1)C(2) | 442 | 537 | 630 | 536 | 695 |
| 4 | Invention | M101 | 103 | Y(2) | M(1) | C(2)C(3) | 442 | 537 | 625 | 536 | 712 |
| 5 | Invention | M101 | 104 | Y(3) | M(2) | C(4)C(2) | 451 | 537 | 630 | 536 | 695 |
| 6 | Invention | M101 | 105 | Y(1) | M(3) | C(1)C(2) | 451 | 537 | 630 | 536 | 695 |
| 9 | Invention | M102 | 100 | Y(1) | M(1) | C(1)C(2) | 451 | 537 | 630 | 536 | 695 |
| 10 | Invention | M102 | 101 | Y(1) | M(1) | C(2)C(3) | 451 | 537 | 625 | 536 | 712 |

TABLE 23-continued

| | | | | | | | | | | | |
|---|---|---|---|---|---|---|---|---|---|---|---|
| 12 | Comparison | M101 | 106 | Y(1) | M(1) | C(1) | 451 | 537 | 628 | 530 | 681 |
| 13 | Comparison | M101 | 107 | Y(1) | M(1) | C(5) | 451 | 537 | 629 | 524 | 680 |

| No. | λc(10%−)−λc(10%+) | Color Reproduction Region, Comparison with Standard Print Color Chart (L = 60) | Coloration (Visual Judgement), Comparison with Standard Print Color Chart (L = 60) | Black Dmax, Visual Density | Light Source Dependency (Visual Judgement |
|---|---|---|---|---|---|
| 1 | 159 | 0 | ○ | 1.95 | ○ |
| 2 | 176 | 0 | ○ | 1.97 | ○ |
| 3 | 159 | 0 | ○ | 1.94 | ○ |
| 4 | 176 | 0 | ○ | 1.95 | ○ |
| 5 | 159 | 0 | ○ | 1.93 | ○ |
| 6 | 159 | 0 | ○ | 1.94 | ○ |
| 9 | 159 | 0 | ○ | 1.93 | ○ |
| 10 | 176 | 0 | ○ | 1.94 | ○ |
| 12 | 151 | 0 | ○ | 1.78 | x |
| 13 | 156 | −8.10 | x | 1.90 | ○ |

As the standard color print charts, charts using Toyo High Plus Ink were used.

λc(10%−): the wavelength at which an absorption intensity in the wavelength region shorter than the wavelength, at which a cyan dye shows an absorption intensity peak, reaches 10% of a peak absorption intensity.

λc(10%+): the wavelength at which an absorption intensity in the wavelength region longer than the wavelength, at which a cyan dye shows an absorption intensity peak, reaches 10% of a peak absorption intensity.

The results shown in Table 23 reveal that the samples of Nos. 1 to 6, 9 and 10 of this invention exhibit almost no difference in color with the printed matter, give high image density, and exhibit almost no change of coloration according to the lighting light source, namely have excellent light source dependency, as compared to the comparative samples of Nos. 12 and 13, so that they have an ideal performance as color proofs for print correction.

What is claimed is:

1. A heat developable color light-sensitive material provided on a support, which is for use in an image forming process comprising using a dye fixing element which is provided on a support separate from the support for said light-sensitive material, superposing one on another, heat developing to form a diffusible dye in said light sensitive material, and transferring the diffusible dye to the dye fixing element to form an image, which light sensitive material comprises at least a light-sensitive silver halide and dye-donating compounds, and forms or releases diffusible yellow, magenta and cyan dyes by the heat development, said diffusible cyan dye comprising at least two kinds of cyan dyes, said yellow dye showing the maximum absorption intensity in spectral absorption at a wavelength of from 440 nm to 460 nm, said magenta dye showing the maximum absorption intensity in spectral absorption at a wavelength of from 525 nm to 545 nm, said cyan dye showing the maximum absorption intensity in spectral absorption at a wavelength of from 610 nm to 640 nm, and the absorption intensity of the cyan dye satisfying the following requirements (1) to (3):

(1) the wavelength (λC(10%−)) at which an absorption intensity in the short-wavelength side of the cyan dye reaches 10% of a peak absorption intensity is 525 nm to 545 nm;

(2) the wavelength (λC(10%+)) at which an absorption intensity in the long-wavelength side of the cyan dye reaches 10% of a peak absorption intensity is 690 nm or more; and (3) the difference between λC(10%+) and λC(10%−) (λC(10%+)−λC(10%−)) is 155 nm or more.

2. The heat developable color light-sensitive material as claimed in claim 1, wherein said light sensitive material contains one of a slightly soluble metal compound and a compound which forms a complex with a metal ion constituting the slightly soluble metal compound, and the dye fixing element contains the other compound, to thereby undergo a two-component reaction to form an alkali necessary for the development of the silver halide.

3. The heat developable color light-sensitive material as claimed in claim 1, wherein the dye-donating compound for a cyan diffusible dye comprises at least one azonaphthol or azophenol compound.

* * * * *